US008876203B1

(12) United States Patent
Haertl et al.

(10) Patent No.: US 8,876,203 B1
(45) Date of Patent: Nov. 4, 2014

(54) COLLAPSIBLE CHAIR

(71) Applicant: Abida LLC, Camas, WA (US)

(72) Inventors: Roland A. Haertl, Camas, WA (US); David E. Gilman, Camas, WA (US)

(73) Assignee: Abida LLC, Camas, WA (US)

( * ) Notice: Subject to any disclaimer, the term of this patent is extended or adjusted under 35 U.S.C. 154(b) by 0 days.

(21) Appl. No.: 14/173,736

(22) Filed: Feb. 5, 2014

(51) Int. Cl.

| | |
|---|---|
| ***A47C 1/00*** | (2006.01) |
| ***A47C 4/00*** | (2006.01) |
| ***A47C 13/00*** | (2006.01) |
| ***A47C 4/04*** | (2006.01) |

(52) U.S. Cl.
CPC ..... *A47C 4/04* (2013.01)
USPC ..... 297/118; 297/4; 297/16.1; 297/16.2; 297/29; 297/56; 297/129; 297/130

(58) Field of Classification Search
CPC ..... A45B 5/00
USPC ..... 297/4, 16.1, 16.2, 29, 56, 118, 129, 130
See application file for complete search history.

(56) References Cited

U.S. PATENT DOCUMENTS

| | | | | | |
|---|---|---|---|---|---|
| 295,216 | A | * | 3/1884 | Wright | 297/56 |
| 542,609 | A | * | 7/1895 | Gordon et al. | 248/155.3 |
| 574,011 | A | * | 12/1896 | Springsted | 297/56 |
| 617,661 | A | * | 1/1899 | Smith | 297/118 X |
| 767,246 | A | * | 8/1904 | Rogers | 248/155.3 |
| 954,473 | A | * | 4/1910 | Schocke | 248/155.4 |
| 1,089,295 | A | * | 3/1914 | Vallier | 248/155.1 |
| 1,972,668 | A | | 9/1934 | Sheldon | |
| 2,002,118 | A | * | 5/1935 | Johnson | 297/118 X |
| 2,127,976 | A | * | 8/1938 | K-Howat | 135/66 |
| 2,133,047 | A | * | 10/1938 | Sheldon | 297/55 |
| 2,380,437 | A | * | 7/1945 | Homrighausen | 297/118 X |
| 2,542,040 | A | | 2/1951 | MacLellan | |
| 2,629,429 | A | * | 2/1953 | Baumfeld et al. | 297/118 X |
| 2,649,140 | A | * | 8/1953 | Housel | 297/57 X |
| 2,771,938 | A | * | 11/1956 | Neblich | 248/155.2 |
| 2,798,536 | A | * | 7/1957 | Shew | 248/155.2 |
| 3,266,839 | A | * | 8/1966 | Combs | 297/57 |
| 3,310,340 | A | * | 3/1967 | Brewer et al. | 297/16.1 |

(Continued)

FOREIGN PATENT DOCUMENTS

| | | |
|---|---|---|
| CN | 2115702 U | 9/1992 |
| CN | 2167583 Y | 6/1994 |

(Continued)

OTHER PUBLICATIONS

Everwhere Chair, LLC, http://everywherechair.com/stick-chair.html#.UrCf0p3Tm71, "The Original Stick Chair, Collapsible Folding Seat, and Walking Cane" accessed Dec. 6, 2013.

(Continued)

*Primary Examiner* — Rodney B White
(74) *Attorney, Agent, or Firm* — Kolisch Hartwell, P.C.

(57) ABSTRACT

A chair operable between an extended configuration and a collapsed configuration includes one or more legs, a handle and a locking mechanism. The one or more legs support a seat and the handle extends away from the seat opposite the one or more legs. The locking mechanism includes a lock plug disposed in an elongate trough. Movement of the handle between the extended and collapsed configurations involves depressing the lock plug and flipping the trough to an opposite side of the lock plug.

17 Claims, 19 Drawing Sheets

(56) References Cited

U.S. PATENT DOCUMENTS

| | | | | | |
|---|---|---|---|---|---|
| 3,544,051 | A * | 12/1970 | Norman | 248/155 |
| 4,317,519 | A * | 3/1982 | Talley | 297/129 X |
| 4,603,902 | A | 8/1986 | Maloney | |
| 4,685,732 | A | 8/1987 | Kapp et al. | |
| D338,345 | S | 8/1993 | Camp | |
| 5,411,313 | A * | 5/1995 | Counihan et al. | 297/118 |
| 5,433,234 | A * | 7/1995 | Lapere | 135/66 |
| D396,569 | S | 8/1998 | Chen | |
| 6,192,908 | B1 * | 2/2001 | Smith | 135/66 |
| 6,478,375 | B2 | 11/2002 | Richardson | |
| 6,651,684 | B2 * | 11/2003 | Spitzer | 135/78 |
| 6,899,388 | B1 * | 5/2005 | Enrique | 297/16.2 X |
| 7,219,679 | B2 * | 5/2007 | Hsu et al. | 135/66 |
| 7,316,449 | B2 * | 1/2008 | Lynch et al. | 297/4 |
| 2013/0074743 | A1 * | 3/2013 | Li | 297/118 X |
| 2014/0034097 | A1 * | 2/2014 | Pao | 135/66 |
| 2014/0034098 | A1 * | 2/2014 | Pao | 135/66 |
| 2014/0060598 | A1 * | 3/2014 | Pao | 135/66 |

FOREIGN PATENT DOCUMENTS

| | | | |
|---|---|---|---|
| CN | 1095252 | A | 11/1994 |
| CN | 2200951 | Y | 6/1995 |
| CN | 2279092 | Y | 4/1998 |
| CN | 2332225 | Y | 8/1999 |
| CN | 2420887 | Y | 2/2001 |
| CN | 2462719 | Y | 12/2001 |
| CN | 1596793 | A | 3/2005 |
| CN | 201001527 | Y | 1/2008 |
| CN | 201328443 | Y | 10/2009 |
| CN | 201630380 | U | 11/2010 |
| CN | 202014869 | U | 10/2011 |
| CN | 202236165 | U | 5/2012 |
| CN | 202396623 | U | 8/2012 |
| CN | 202445280 | U | 9/2012 |
| EP | 2292121 | A1 | 3/2011 |
| GB | 125269 | | 4/1919 |
| GB | 269715 | | 4/1927 |
| GB | 391666 | | 5/1933 |
| JP | 09-075172 | | 3/1997 |
| JP | 2007-209590 | | 8/2007 |

OTHER PUBLICATIONS

Hornung's Golf Products, Inc., http://www.ebay.com/bhp/golf-folding-chair, "Golf Spectator Seat Stick Outdoor Adjustable Folding Walking Cane and Chair", accessed Dec. 6, 2013.

MacSports Inc., http://universaldesignproducts.com/store/B006JPYV, "Folding Cane Chair—Walking Stick with Tripod Stool", accessed Dec. 6, 2013.

* cited by examiner

COLLAPSIBLE CHAIR

TECHNICAL FIELD

The disclosure relates to chairs. More particularly, the disclosure relates to collapsible chairs.

INTRODUCTION

Generally, collapsible chairs are used for seating in areas where permanent seating is not possible or practical. This includes outdoor and indoor events such as funerals, college graduations, religious services, sporting events and competitions, and the like. In addition, collapsible chairs may be used for any situation that may require extra seating.

Collapsible chairs exist which are operable between an extended configuration that provides a seating surface, and a collapsed configuration in which the chair may be transported. However, Applicant has found that these pre-existing collapsible chairs are not particularly suitable for travelers, particularly travelers with decreased mobility. For example, pre-existing chairs typically either have a collapsed configuration that is too large to carry onto a commercial airliner, or an extended configuration that does not provide adequate support for a user that has difficulty standing up and sitting down. Also, operating pre-existing collapsible chairs between extended and collapsed configurations (and/or securing these chairs in these configurations) typically involves manipulation of relatively complicated or inconvenient mechanisms.

BRIEF SUMMARY

One or more embodiments of a chair disclosed herein may overcome one or more of the above identified deficiencies of pre-existing collapsible chairs.

In a first example, a chair operable between an extended configuration and a collapsed configuration is provided. The chair may include one or more legs and a handle. The one or more legs may support a seat and the handle may extend away from the seat opposite the one or more legs. The chair may include a locking mechanism having a lock plug disposed in an elongate trough. Movement of the handle between the extended and collapsed configurations may involve depressing the lock plug and flipping the trough to an opposite side of the lock plug.

In a second example, a chair operable between an extended configuration and a collapsed configuration may include one or more legs and a handle. The one or more legs may support a seat, and the handle may extend away from the seat opposite the one or more legs. The handle and the seat may be pivotally connected to at least one of the legs about a combined pivot axis.

In a third example, a chair operable between an extended configuration and a collapsed configuration may include one or more legs, a handle, and a joint. The one or more legs may support a seat and the handle may extend away from the seat opposite the one or more legs. The joint may pivotally connect the handle to at least one of the legs about a handle pivot axis. The joint may include a locking mechanism for selectively securing the handle in the extended and collapsed configurations.

Figure 1:
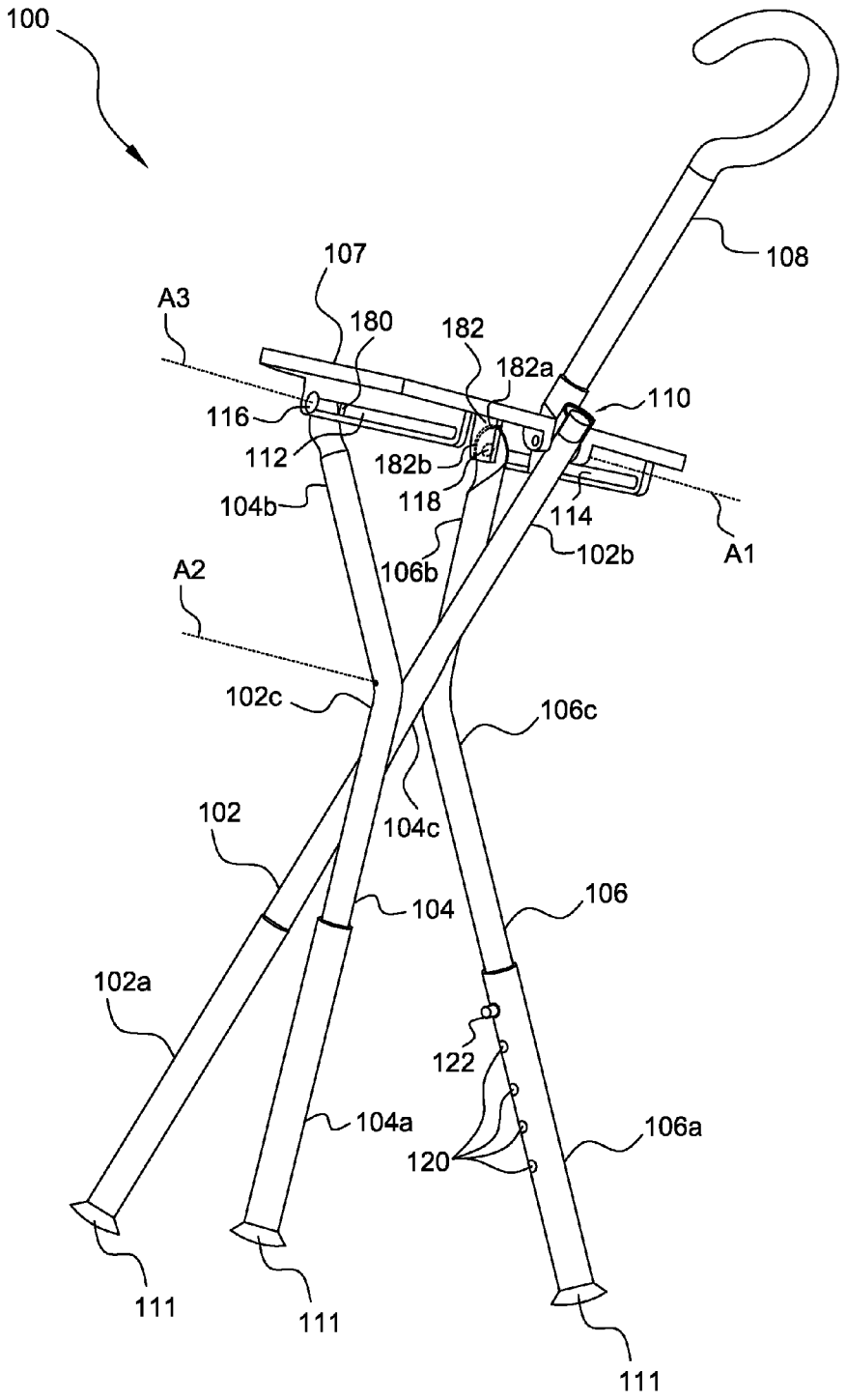
FIG. 1 is a perspective view of a chair in an extended configuration, with the chair including a first leg, a second leg, a third leg, a seat, and a joint connecting a handle to the first leg, according to the present disclosure.

Those with ordinary skill in the art will appreciate that the elements in the drawings are illustrated for simplicity and clarity and are not necessarily drawn to scale. For example, the dimensions of some of the elements in the drawings may be exaggerated, relative to other elements, in order to improve the understanding of the disclosure.

There may be additional structures described in the description that are not depicted in the drawings, and the absence of such a drawing should not be considered as an omission of such design from the specification.

DETAILED DESCRIPTION

FIG. 1 shows a perspective view of a chair 100, according to the present disclosure. As shown, chair 100 may include one or more legs, such as a first leg 102, a second leg 104, and a third leg 106, a seat 107, and a handle 108. As shown, handle 108 may extend away from seat 107 opposite legs 102, 104, and 106.

The one or more legs may support seat 107. For example, respective lower portions 102*a*, 104*a*, and 106*a* of legs 102, 104, and 106 may include respective feet 111 that may be positioned on the ground to substantially stabilize seat 107 against vertical and lateral forces.

First leg 102 may be a rear leg of chair 100, and second and third legs 104 and 106 may be a pair of front legs of chair 100. For example, a user may sit on seat 107, such that the user faces handle 108 with handle 108 extending upward between the user's legs. Second and third legs 104 and 106 of chair 100 may press against the ground proximate the legs of the user, and first leg 102 may press against the ground under and/or behind the user's posterior. In this position, the user may easily grasp an upper portion of handle 108, shown here as resembling a curved cane handle, for increased stability. In this extended configuration, seat 107 may be generally parallel to the ground and may define a sitting surface for the user to sit thereon comfortably.

Figure 13:
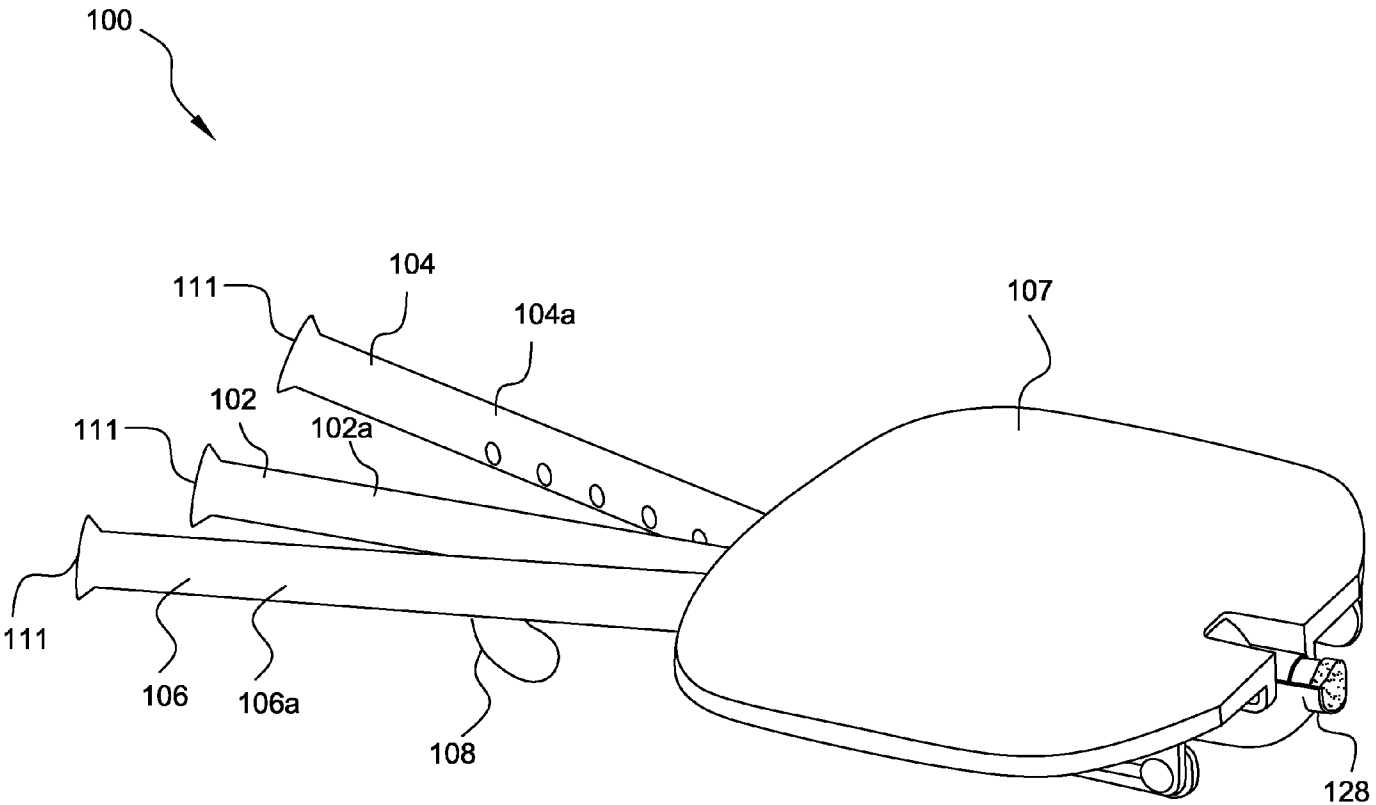
FIG. 13 is a perspective view of the chair of FIG. 1 in a collapsed configuration.
Figure 14:
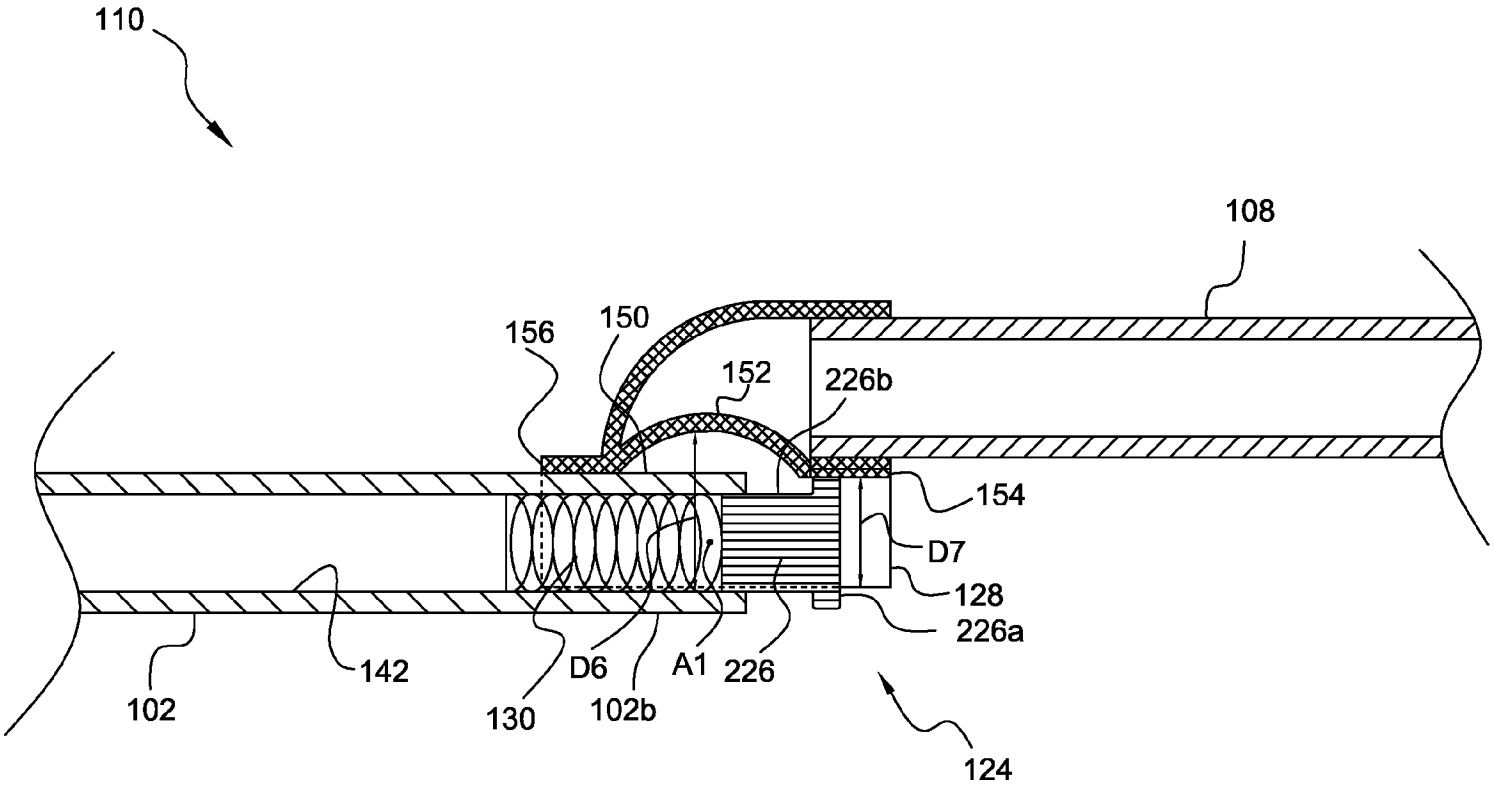
FIG. 14 is a semi-schematic cross-sectional view of the joint of FIG. 1 showing another embodiment of a lock plug in the OUT position to extend into and frictionally engage the first end portion of the trough to secure the handle in the extended configuration.
Figure 15:
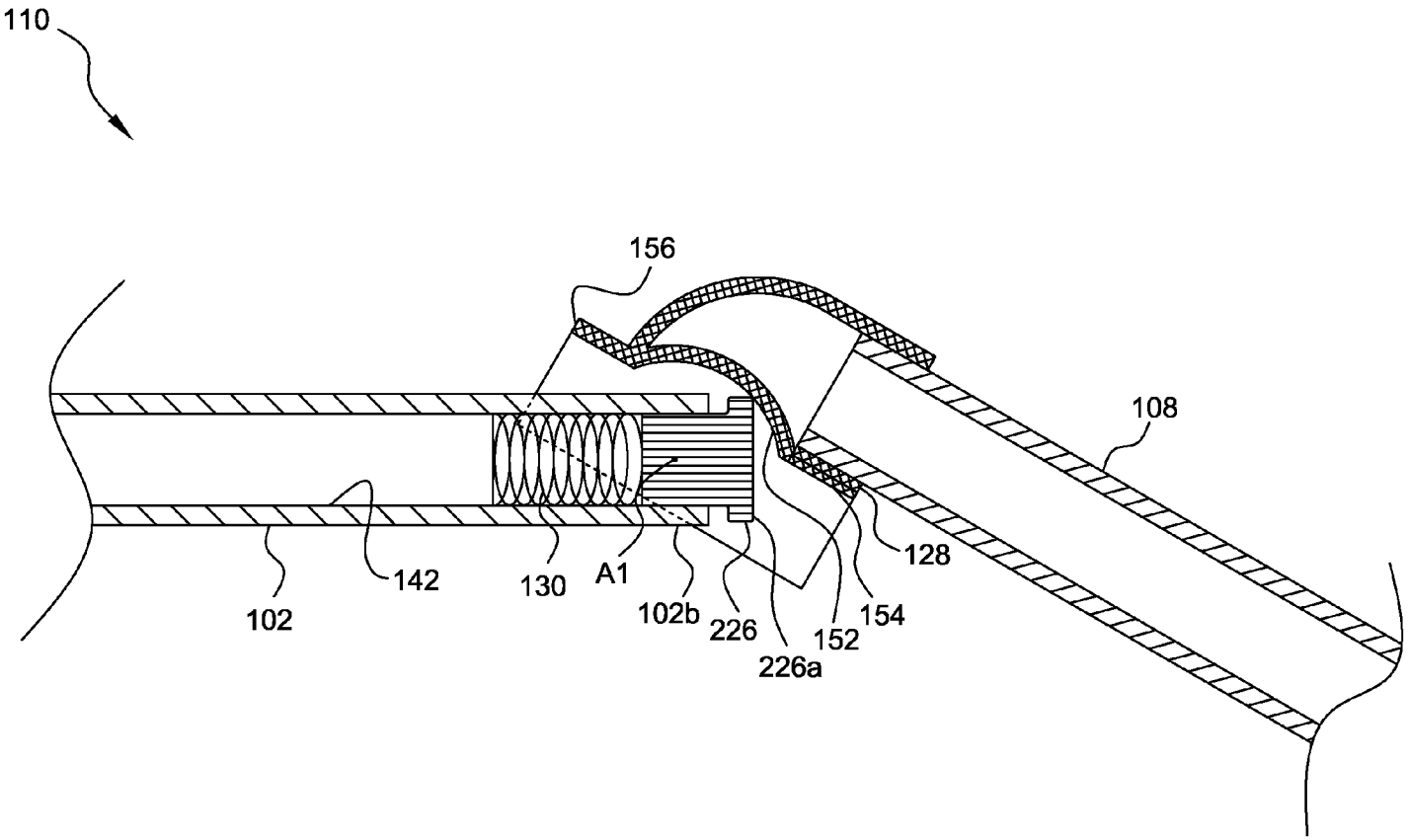
FIG. 15 is a semi-schematic cross-sectional view of the joint showing the lock plug of FIG. 14 depressed to the IN position and the handle pivoted toward the first leg about the handle pivot axis.
Figure 16:
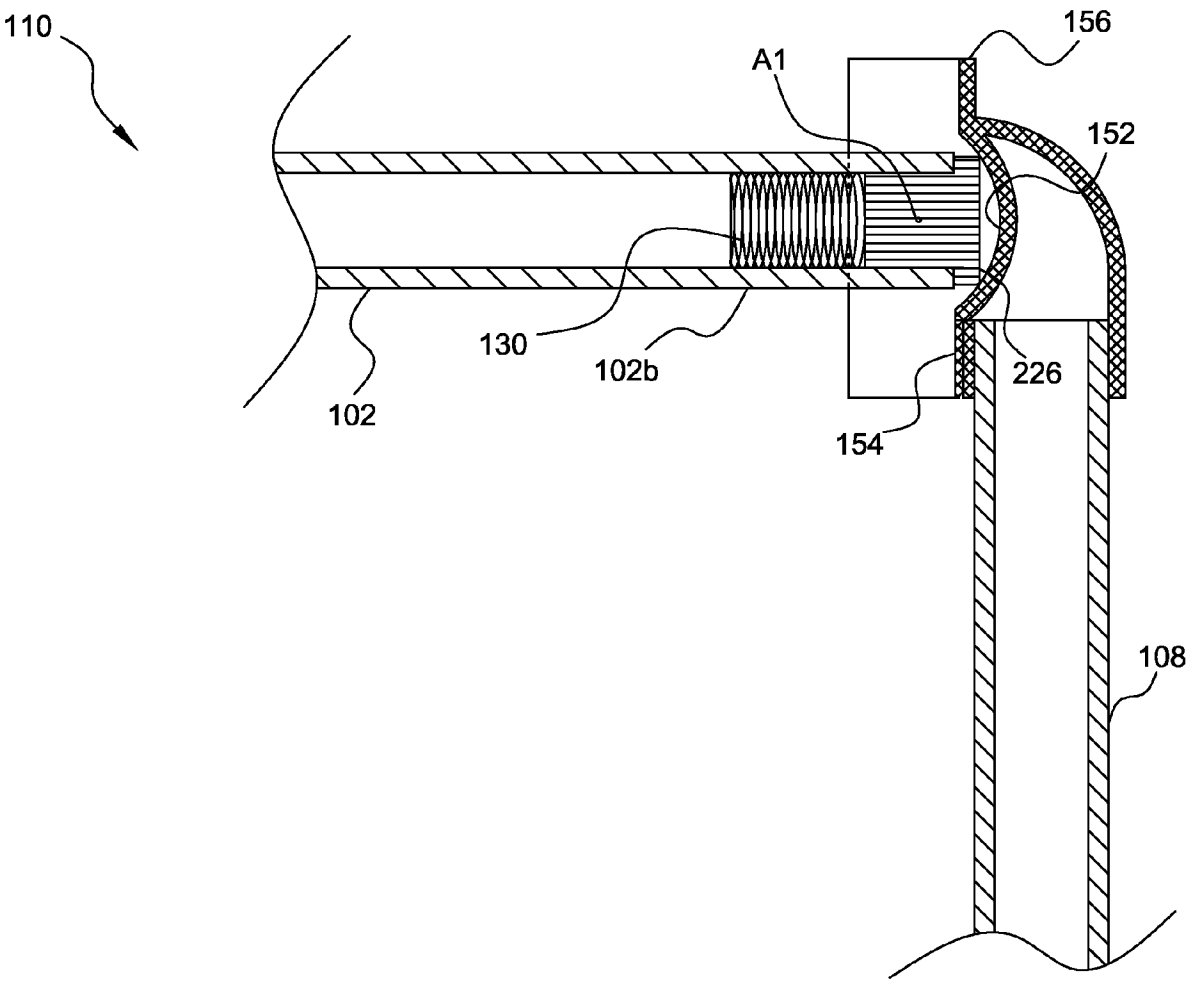
FIG. 16 is a semi-schematic cross-sectional view of the joint showing the handle further pivoted about the handle pivot axis, and the lock plug of FIG. 14 further depressed into the bore of the first leg.
Figure 17:
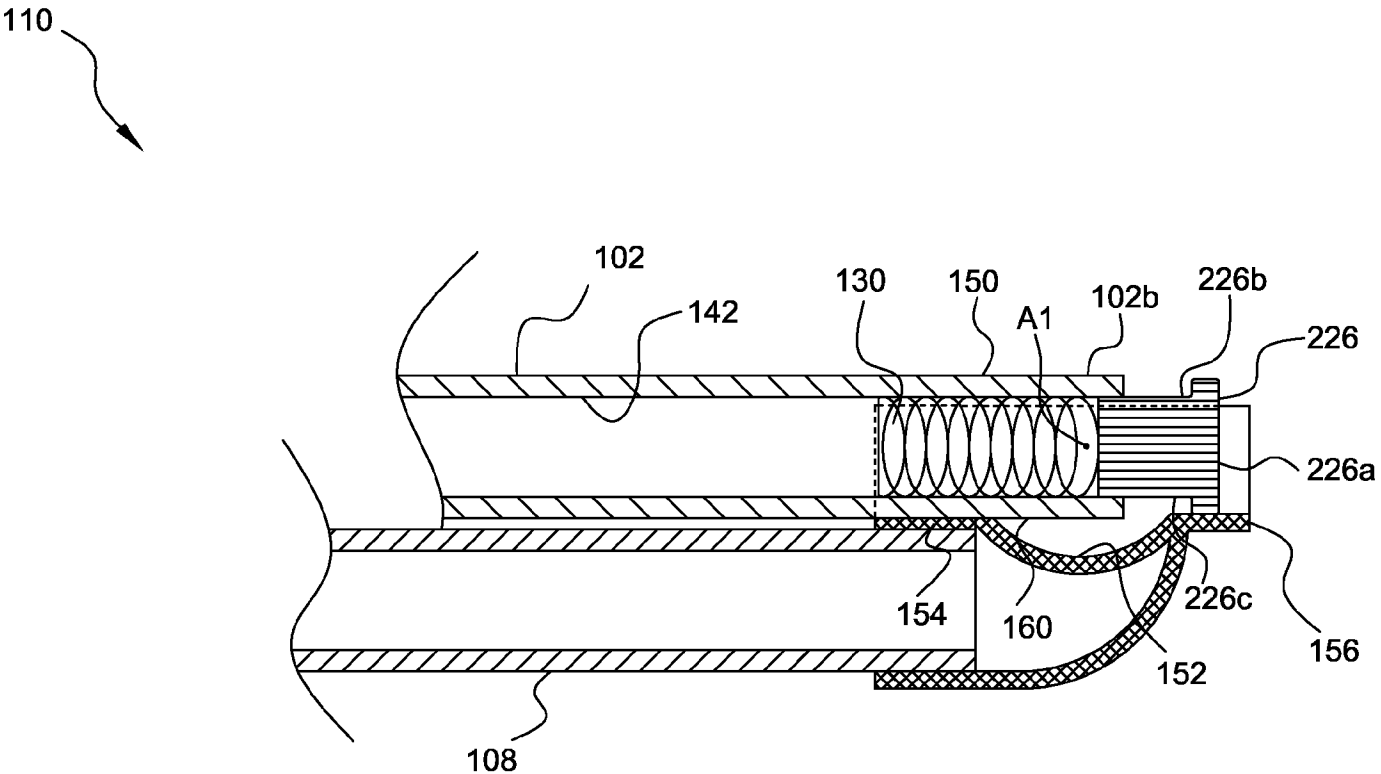
FIG. 17 is a semi-schematic cross-sectional view of the joint showing the lock plug of FIG. 14 in the OUT position to extend into and frictionally engage the second end portion of the trough to secure the handle in the collapsed configuration.

Chair 100 may be operable between an extended configuration (shown in FIG. 1) and a collapsed configuration (shown in FIG. 13). In the extended configuration, chair 100 may be dimensioned to provide both stability and convenience, particularly for users with decreased mobility. For example, in the extended configuration, seat 107 may be supported at a height above the ground that is similar to that of a conventional chair, such as at a height of about 18 to 24 inches, and handle 108 may extend upward to a height similar to that of a chest region of the user when seated, so that the user may simultaneously hold handle 108 and easily sit down on and stand up from seat 107 without excessive bending.

In the collapsed configuration (see FIG. 13), chair 100 may have overall dimensions that allow chair 100 to be easily carried and/or stowed (e.g., for convenient travel). For example, chair 100 in the collapsed position may have an overall length that is less than or equal to a predetermined longest allowable exterior dimension of a carry-on airline luggage piece (which in the United States is currently 19.5 inches), so that the user may stow chair 100 in the collapsed position in an overhead compartment of a commercial airliner.

Applicant has found that incorporating one or more of the following features into a chair, according to aspects of the present disclosure, may provide for both increased stability and convenience of the chair in the extended and/or collapsed configurations (and/or movement there between).

Figure 2:
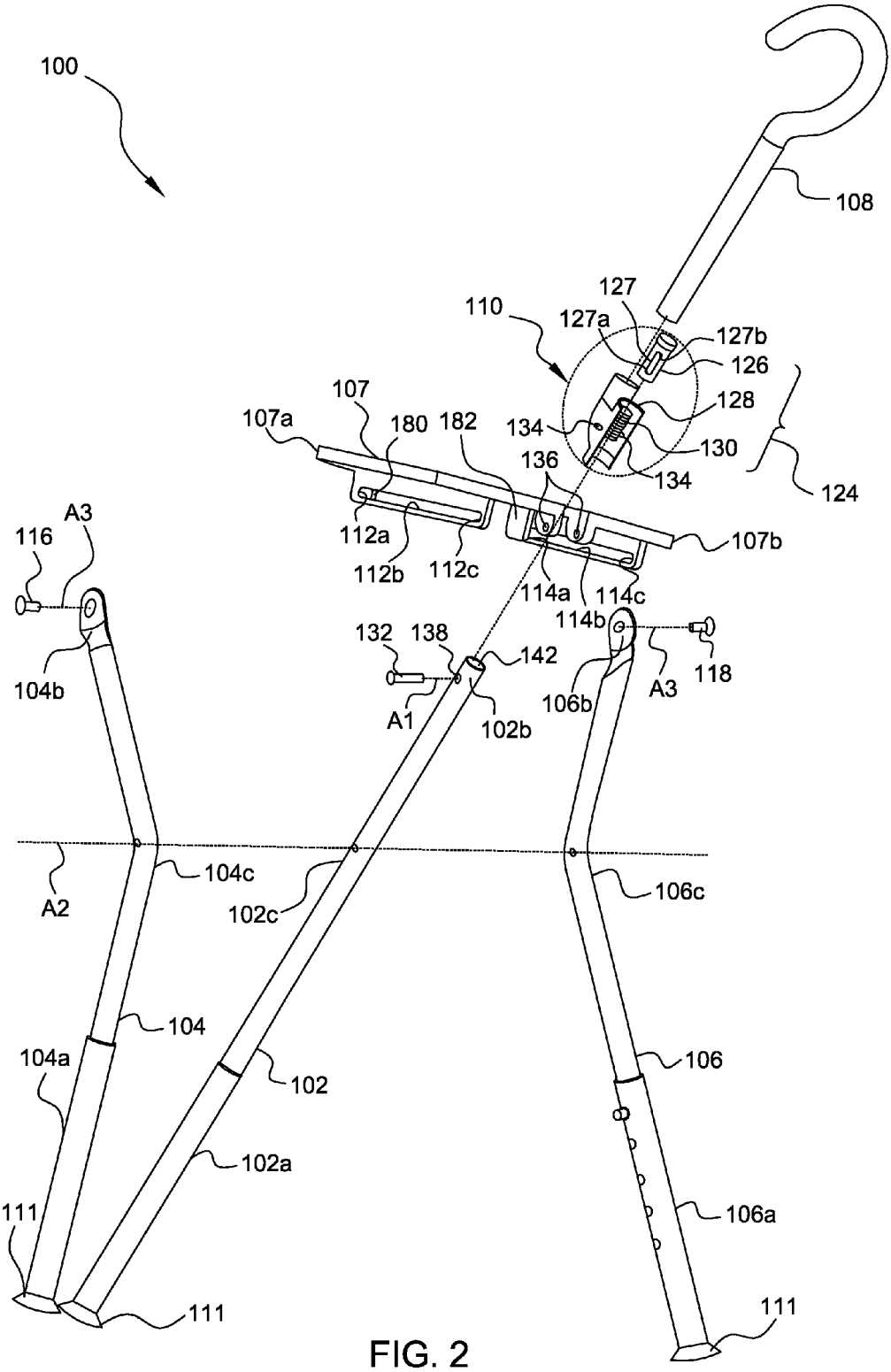
FIG. 2 is an exploded view of the chair of FIG. 1.

For example, as shown in FIGS. 1 and 2, chair 100 may include a joint 110. Joint 110 may pivotally connect handle 108 to at least one of the one or more legs. As shown, joint 110 pivotally connects handle 108 to first leg 102 about a handle pivot axis A1. First leg 102 may include an upper portion 102*b* connected to lower portion 102*a* by a central portion 102*c*, and as shown, joint 110 may pivotally connect handle 108 to upper portion 102*b*. Pivoting of handle 108 about axis A1 may involve handle 108 moving or pivoting toward lower portions 102*a*, 104*a*, and 106*a* of respective legs 102, 104, and 106 about axis A1.

The one or more legs may be pivotally connected to one another about a leg pivot axis A2. Second leg 104 may include an upper portion 104*b* connected to lower portion 104*a* by a central portion 104*c*. Third leg 106 may include an upper portion 106*b* connected to lower portion 106*a* by a central portion 106*c*. Central portion 102*c* of first leg 102 may be pivotally connected to central portions 104*c* and 106*c* of respective legs 104 and 106.

Seat 107 may include first and second seat slots 112 and 114. Upper portion 104*b* of leg 104 may include a pin 116 slidingly engaged in slot 112, and upper portion 106*b* of leg 106 may include a pin 118 slidingly engaged in slot 114. Pins 116 and 118 may define a sliding axis A3. As shown, axes A3, A2, and A1 may be parallel to one another.

Upper portions 104*b* and 106*b* of legs 104 and 106 may pivot toward upper portion 102*b* of leg 102 about axis A2, as lower portions 104*a* and 106*a* of legs 104 and 106 pivot toward lower portion 102*a* of leg 102 about axis A2, which may also involve axis A3 (and associated upper portions 104*b* and 106*b*) sliding in respective seat slots 112 and 114 toward joint 110.

Seat 107 may also be pivotally connected to leg 102 about axis A1, thus axis A1 may be described as a combined pivot axis for both handle 108 and seat 107. In other embodiments, seat 107 and handle 108 may be pivotally connected to leg 102 about different pivot axes.

Seat 107 may pivot about axis A1 away from axis A2 (see FIG. 1), as axis A3 slides toward joint 110 (or associated upper portion 102*b* of leg 102) from distal ends 112*a* and 114*a* to central portions 112*b* and 114*b* of respective seat slots 112 and 114 (see FIG. 2).

Seat 107 may pivot about axis A1 toward axis A2 (see FIG. 1), as axis A3 slides toward upper portion 102*b* from central portions 112*b* and 114*b* to proximal portions 112*c* and 114*c* of respective seat slots 112 and 114 (see FIG. 2).

Each of lower portions 102*a*, 104*a*, and 106*a* of legs 102, 104 and 106 may include a plurality of apertures 120 and a push button mechanism 122. Mechanism 122 may be configured to selectively engage any one of apertures 120, which may allow for the lower portions 102*a*, 104*a*, and 106*a* of the legs 102, 104 and 106 to be selectively telescoped in (e.g., toward axis A2) and to be selectively telescoped out (e.g., away from axis A2).

As can be seen in FIG. 2, joint 110 may include a locking mechanism 124 including a lock plug 126 having a slot 127 with first and second ends 127*a* and 127*b*, an elongate trough 128, and a spring 130. Plug 126 may be disposed in trough 128, and spring 130 may press against plug 126. Trough 128 may be fixedly attached to (or included in) handle 108. Trough 128 may be pivotally connected to leg 102 about axis A1. Locking mechanism 124 may be configured to selectively secure handle 108 in the extended configuration and in the collapsed configuration, which is described in more detail below in relation to FIGS. 6-17.

Axis A1 may be defined by a pin 132 extending through a pair of apertures 134 in trough 128, through a pair of apertures 136 in seat 107, through a pair of apertures 138 in upper portion 102*b* of leg 102, and through slot 127 of plug 126. In other embodiments, axis A1 may be defined by another suitable structure or mechanism, such as a pair of protrusions extending from opposite sides of upper portion 102*b* through apertures 134 and 136.

Axis A2 may be defined by a pin 140 extending through apertures in the central portions of legs 102, 104, and 106. In other embodiments, axis A2 may be defined by another suitable structure or mechanism.

As shown in FIG. 2, first leg 102 may have a hollow cylindrical shape and may include a bore 142. Bore 142 may extend from upper portion 102*b* toward central portion 102*c* of first leg 102.

Plug 126 may have a pair of slots 127 extending substantially parallel to an elongate direction of plug 126. The pair of slots 127 may be on opposite sides of plug 126. Spring 130 may be disposed in a hollow recess of plug 126 (see FIGS. 6, 8, 10, and 12). Plug 126 may be disposed in bore 142. Pin 132 may extend through and be slidingly engaged in slot(s) 127. Pin 132 may retain spring 130 inside the hollow recess of plug 126 between pin 132 and a distal end (or cap portion) of plug 126 (see FIGS. 6, 8, 10, and 12).

Trough 128 may wrap around and/or frictionally engage upper portion 102*b* of leg 102. Pin 132 may provide a surface upon which spring 130 may press to bias lock plug 126 to an OUT position, as will be described below in more detail.

Second leg 104 and third leg 106 may be cylindrical pipes bent at their respective central portions, and may have equal lengths.

As shown in FIG. 2, seat 107 may include a rear portion 107*a* and a front portion 107*b*. Slots 112 and 114 may extend from rear portion 107*a* toward front portion 107*b*. Front portion 107*b* of seat 107 may be pivotally connected to upper portion 102*b* of first leg 102, as described above. Upper portion 104*b* of second leg 104 and upper portion 106*b* of third leg 106 may include respective pins 116 and 118 that may be slidingly engaged in slots 112 and 114, as previously described. Pins 116 and 118 may extend through apertures in the respective upper portions 104*b* and 106*b* of legs 104 and 106.

Figure 3A:
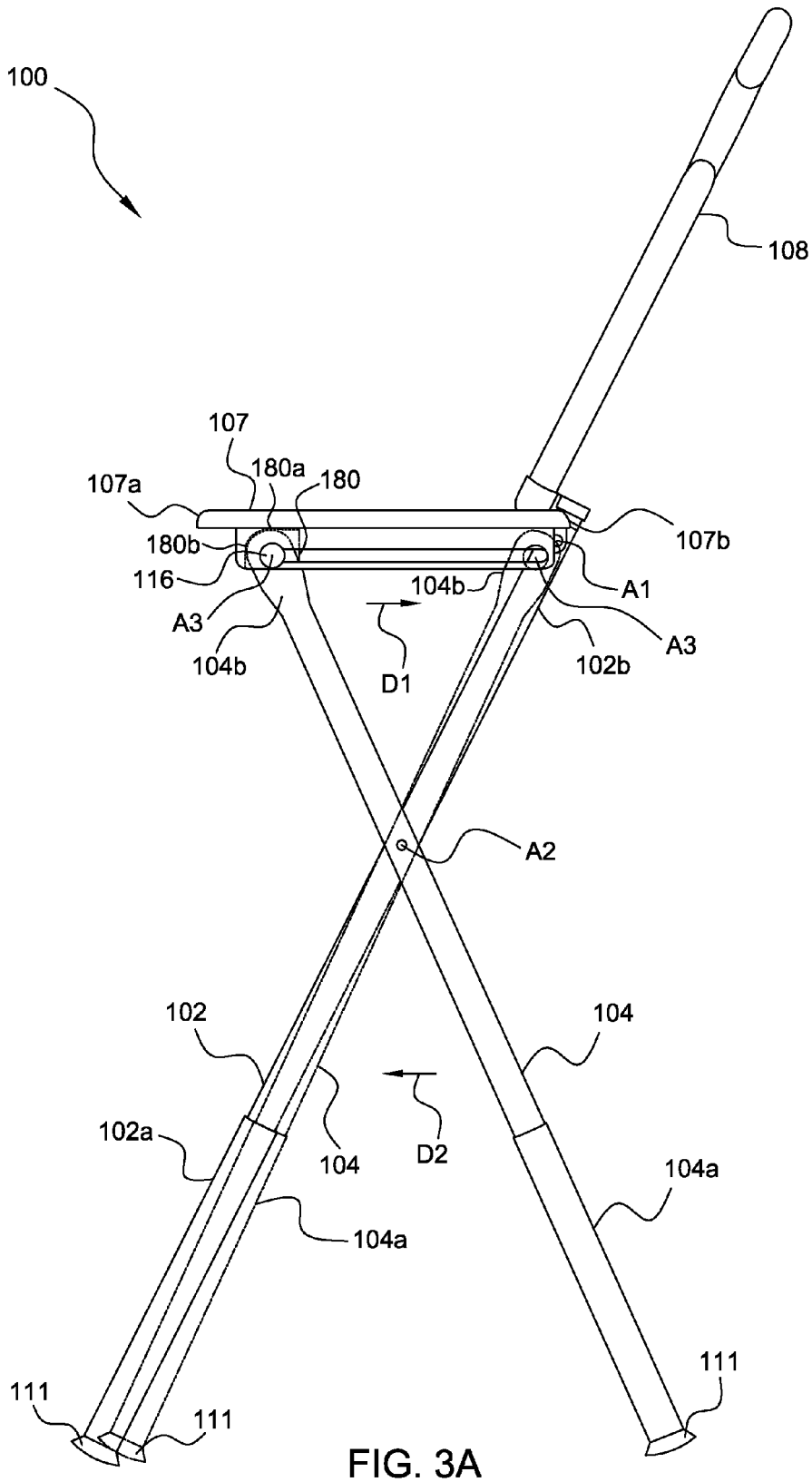
FIG. 3A is a side view of the chair of FIG. 1 showing a direction of leg movement while transitioning the legs to a collapsed configuration from the extended configuration.

As shown in FIG. 3A, leg 104 may move from the extended configuration (shown in solid lines) to the collapsed configuration (shown in dash double dot lines). For example, upper portion 104*b* of leg 104 may pivot about axis A2 toward upper portion 102*b* of leg 102 in a direction D1, and lower portion 104*a* of leg 104 may pivot about axis A2 toward lower portion 102*a* of leg 102 in a direction D2 to position legs 104 and 102 in a substantially flat configuration. Leg 106 may move in a similar fashion as leg 104, as shown in FIG. 4. However, leg 106 would be directly behind leg 104 in FIG. 3, thus leg 106 is not shown in FIG. 3. As shown in FIGS. 1-3C, a pocket (or a pocket formed by a wall) 180 and a pocket (or a pocket formed by a wall) 182 may extend from the bottom of seat 107 and may be proximate and parallel to respective first portion 112*a* of slot 112 and first portion 114*a* of slot 114. In the extended configuration of legs 104 and 106, wall portions of pockets 180 and 182 may bear against surfaces of respective upper portions 104*b* and 106*b* of legs 104 and 106 to reduce or prevent any downward and/or rearward load from being exerted on pins 116 and 118 in respective slots 112 and 114, which may improve the strength of chair 100.

For example, when the user sits on seat 107, a rearward load (in a direction away from front portion 107*b* and toward rear end portion 107*a*) and a downward load may be exerted on cantilevered upper portions 104*b* and 106*b*. If these loads were applied to pins 116 and 118, then these pins may bend, or in some cases may break (e.g., if the user is relatively large). However, by providing wall portions against which top and rear surfaces of upper portions 104*b* and 106*b* may press in the extended configuration, any load on pins 116 and 118 may be eliminated (or greatly reduced).

For example, as shown in FIG. 1, an upper wall portion 182*a* of pocket 182 may press against a top surface of upper portion 106*b* of leg 106 distal pin 118 in the extended configuration of leg 106, and a rear wall portion 182*b* of pocket 182 may press against a rear surface of upper portion 106*b* of leg 106 distal pin 118 in the extended configuration of leg 106.

As shown in FIG. 3A, an upper wall portion 180*a* of pocket 180 may press against a top surface of upper portion 104*b* of leg 104 distal pin 116 in the extended configuration of leg 104, and a rear wall portion 180*b* of pocket 180 may press against a rear surface of upper portion 104*b* of leg 104 distal pin 116 in the extended configuration of leg 104.

As shown in FIGS. 1 and 3A, the wall portions of pockets 180 and 182 may be curved wall portions that may be shaped to correspond to (or closely match) a curvature of respective top and rear surfaces of upper portions 104*b* and 106*b*.

In some embodiments, pocket 180 may wrap upper portion 104*b* of leg 104, and pocket 182 may wrap upper portion 106*b* of leg 106. The rear (or back) surface of upper portion 104*b* of leg 104 may bear against a back wall portion 108*b* of pocket 180, and the rear (or back) surface of upper portion 106*b* of leg 106 may bear against back wall portion 182*b* of pocket 182. The top surface of upper portion 104*b* of leg 104 may bear against upper wall portion 180*a*, and the top surface of upper portion 106*b* of leg 106 may bear against upper wall portion 182*a* of pocket 182. In some embodiments, the upper wall portions of pockets 180 and 182 may be bottom surfaces of seat 107.

Figure 3B:
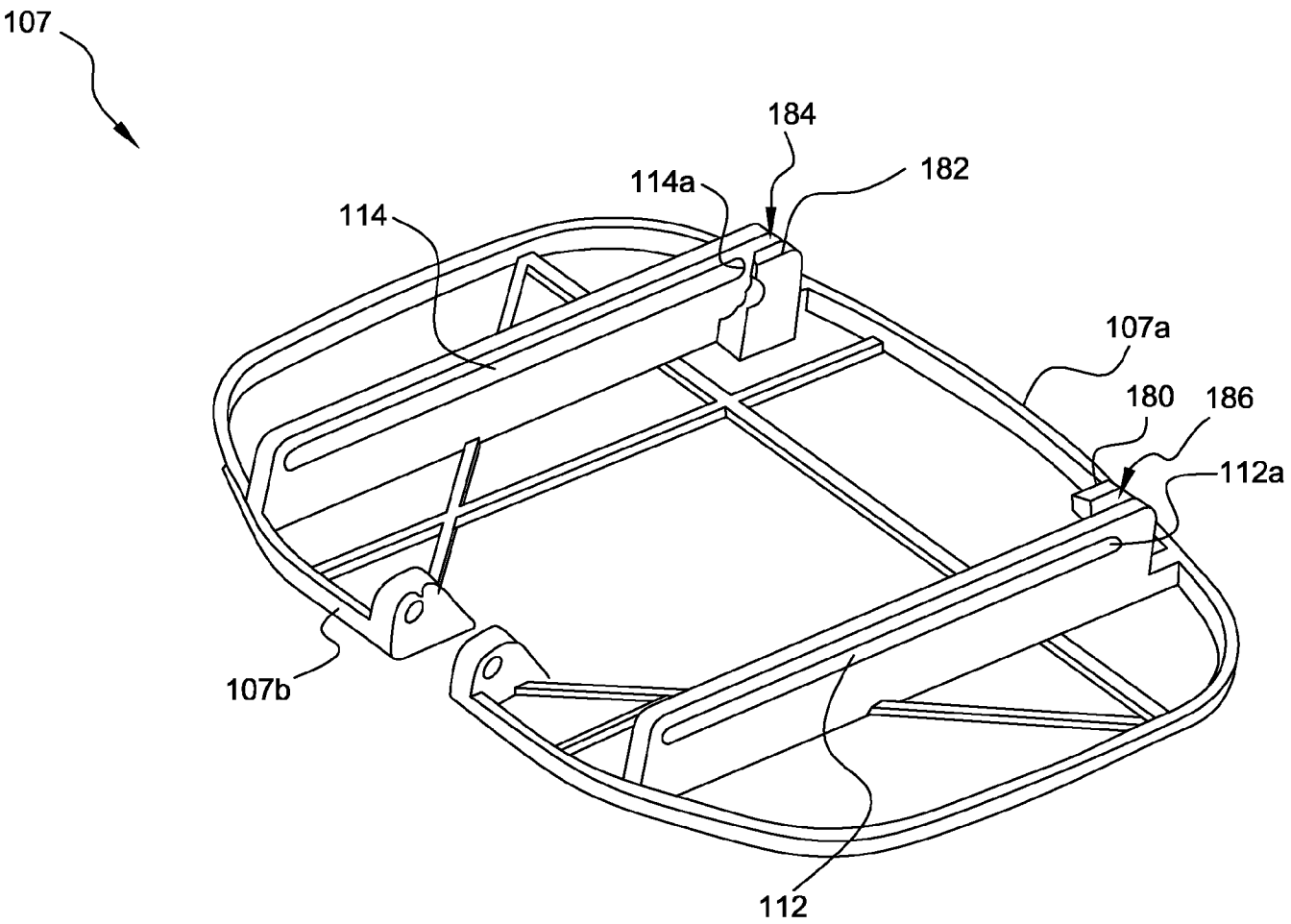
FIG. 3B is a perspective view of a bottom side of the seat of the chair of FIG. 1 showing pockets to support upper portions of the second and third legs in the extended configuration.
Figure 4:
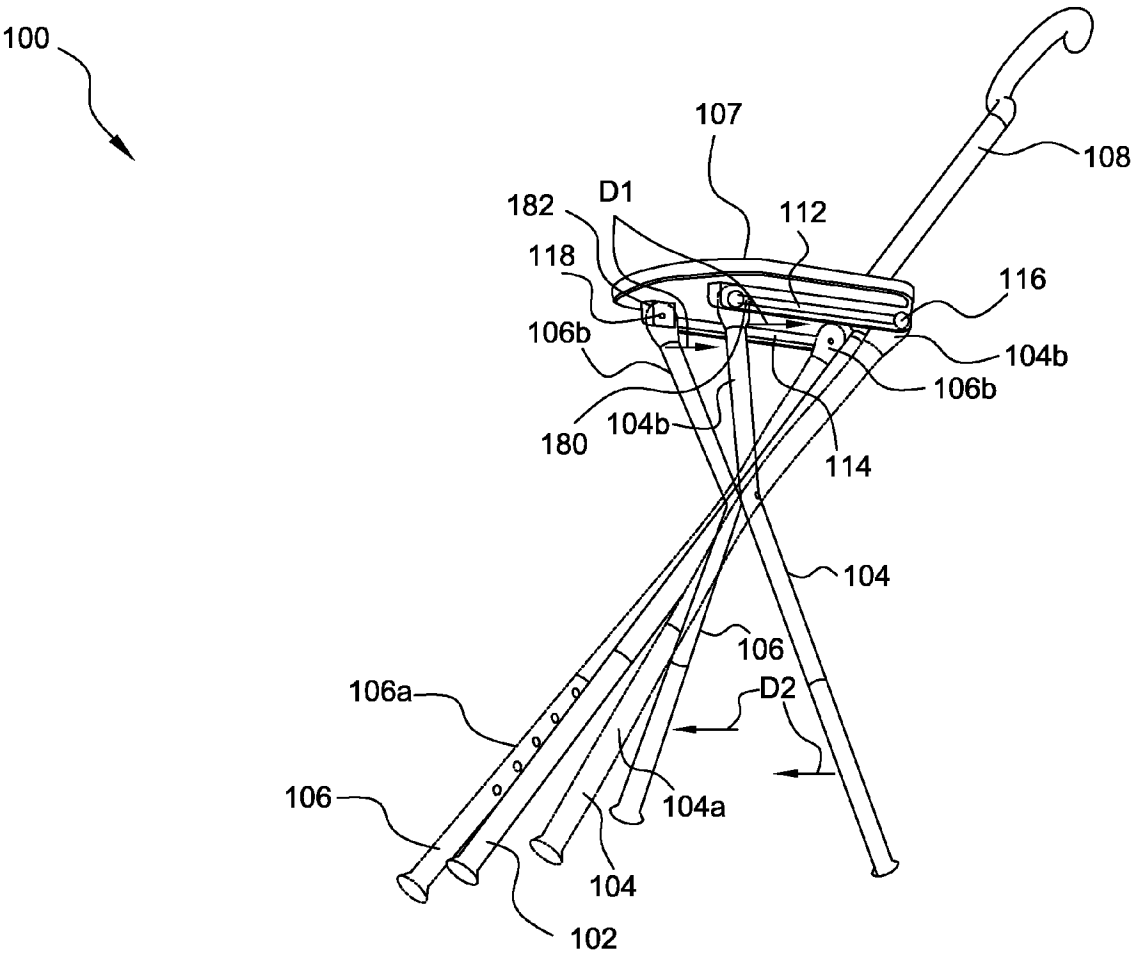
FIG. 4 is a perspective view of the chair of FIG. 1 that similarly shows the direction of leg movement while transitioning the legs to the collapsed configuration from the extended configuration.

FIG. 3B is a bottom perspective view of seat 107 showing walls 180 and 182, which may form the pockets. For example, wall 180 may define a recess 184 in which upper portion 104*b* (see FIG. 3A) may be disposed in the extended configuration, and wall 182 may define a recess 186 in which upper portion 106*b* (see FIG. 1) may be disposed in the extended configuration.

Figure 3C:
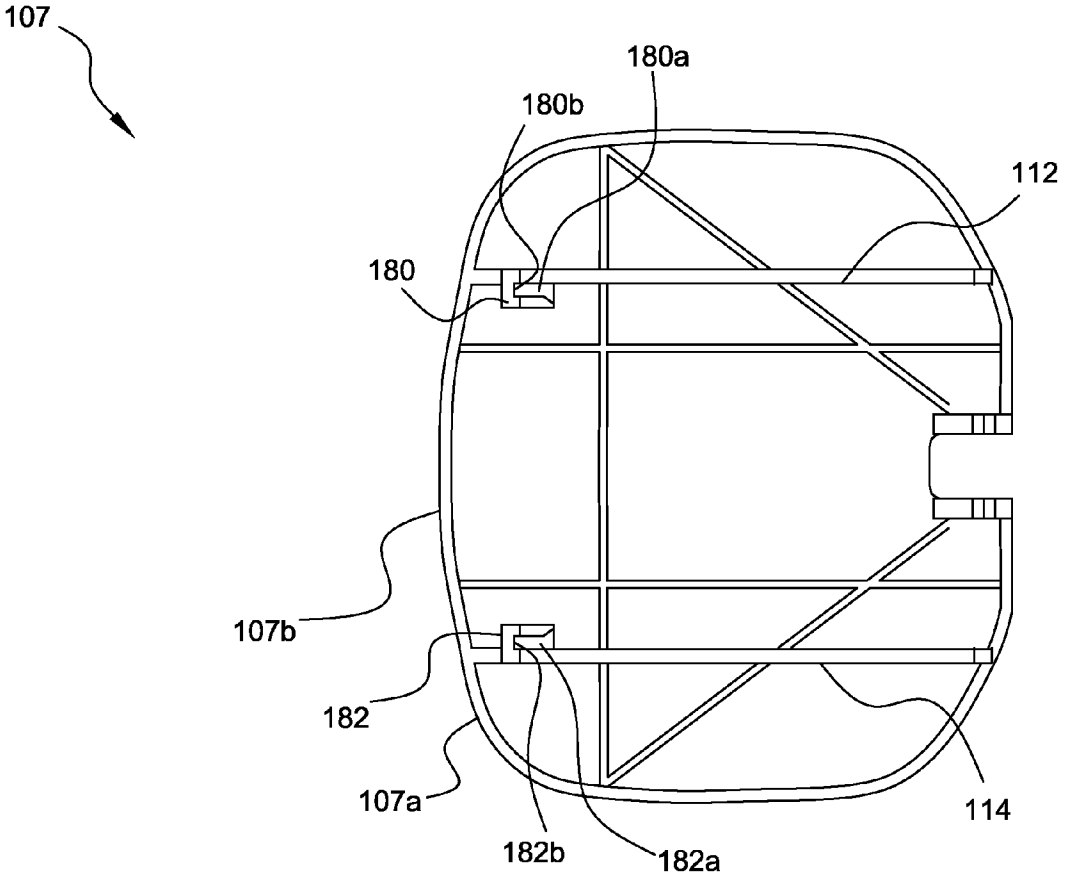
FIG. 3C is a cross-sectional view of the seat of FIG. 3B taken in a plane that extends through the seat slots to show upper and rear wall portions of the pockets for supporting respective rear and top surfaces of the second and third legs.

FIG. 3C is a cross-sectional view of seat 107 taken in a plane parallel to the view of FIG. 3B that passes through slots 112 and 114. As shown, walls (or pockets) 180 and 182 are both generally "c" shaped.

FIG. 4 shows the extended configuration of legs 104 and 106 in solid lines, and the collapsed configuration of legs 104 and 106 in dash double dot lines. As can be seen in FIG. 4, pins 116 and 118 may slide in direction D1 in respective slots 112 and 114 as upper portions 104*b* and 106*b* of second leg and third legs 106 move toward front portion 107*b* of seat 107, and as lower portions 104*a* and 106*a* pivot about axis A2 toward lower portion 102*a* of first leg 102 in direction D2.

Figure 5:
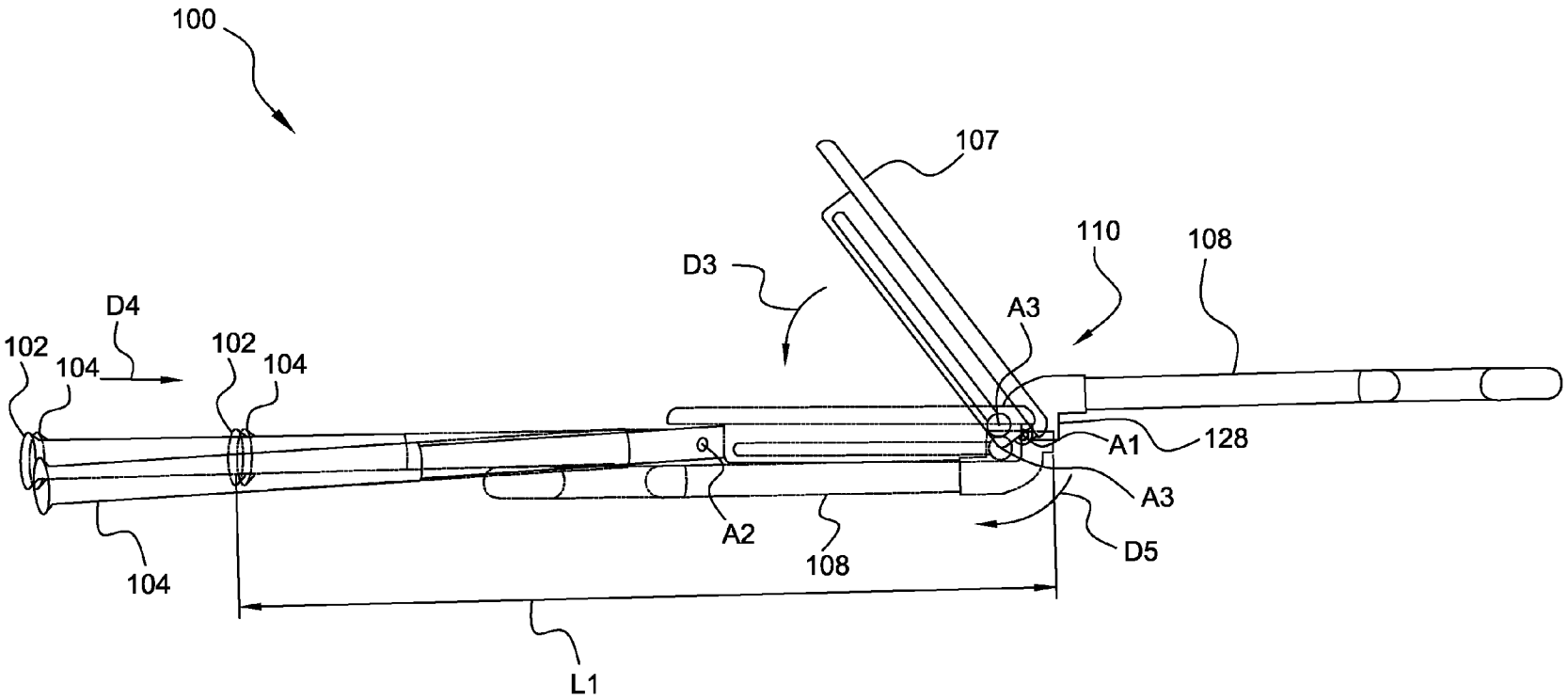
FIG. 5 is a side view of the chair of FIG. 1 showing the seat moving from an extended configuration (drawn in solid lines) to a collapsed configuration (drawn in dash double dot lines), and the handle moving from an extended configuration (draw in solid lines) to a collapsed configuration (drawn in dash double dot lines).

FIG. 5 is a side view of chair 100. In FIG. 5, seat 107 is shown in the extended configuration in solid lines and in the collapsed configuration in dash double dot lines. Movement of seat 107 from the extended configuration to the collapsed configuration may involve pivoting seat 107 about axis A1 in a direction D3. Pivoting seat 107 about axis A1 in direction D3 may result in pivoting axis A3 and associated second leg 104 and third leg 106 (leg 106 is not shown in FIG. 5 because leg 106 would be directly behind leg 104) about axis A2 to align leg 104 (and leg 106) with leg 102. Leg 104, before pivoting about axis A2 is shown in FIG. 5 in solid lines. Leg 104 after pivoting about axis A2 (and aligned with leg 102) is shown in dash double dot lines.

The lower portions of legs 102 and 104 (and leg 106) may be telescoped in toward trough 128 in a direction D4. A telescoped out position of legs 102 and 104 is shown to the left in FIG. 5 (with leg 102 drawn in solid lines and leg 104 drawn in dash double dot lines), and a telescoped in position of legs 102 and 104 (both drawn in dash double dot lines) is shown just to the right of the telescoped out position.

In FIG. 5, handle 108 is shown in the extended configuration in solid lines and in the collapsed configuration in dash double dot lines. Handle 108 may be adapted to pivot toward leg pivot axis A2 (in direction D5) about handle pivot axis A1 to position first leg 102, second leg 104, third leg 106 (not shown here), and handle 108 in a substantially flat configuration.

As described above, seat 107 may be adapted to pivot toward leg pivot axis A2 in direction D4, which may position upper portions 102*b*, 104*b* and 106*b* of first, second, and third legs 102, 104 and 106 between seat 107 and handle 108, as shown in FIG. 5. Leg 104 may slightly rotate about leg pivot axis A2 in a direction opposite to direction D3 when seat 107 moves in direction D3 to the collapsed configuration. Leg 104 and leg 102 (as well as leg 106, which is not shown here) may be aligned when seat 107 reaches the collapsed configuration (shown in double dot dash lines).

It may not be noted that third leg 106 may also move simultaneously with second leg 104 in a direction opposite to direction D3 when seat 107 moves in direction D3. Third leg 106 may be aligned with second leg 104 and first leg 102 when seat 107 is in the collapsed configuration.

As shown in FIG. 5, handle 108 in the collapsed configuration may press against (or be positioned proximal) leg 104 (and/or leg 106) that is substantially aligned with leg 102. Handle 108 pressing against (or securely positioned proximal to) leg 104 (and/or leg 106) may prevent pivoting the upper portions of legs 104 and 106 relative to the upper portion of leg 102, and thereby may prevent seat 107 from moving to the extended configuration. For example, sliding axis A3 is shown as offset from seat pivot axis A1 when legs 102 and 104 are in the collapsed configuration and substantially aligned, which may result in pivoting leg 104 about axis A2 in the direction D3 as seat 107 is pivoted about axis A1 in a direction opposite to direction D3. However, such pivoting seat 107 about axis A1 in a direction opposite to D3 may be arrested (or prevented) by handle 108 pressing against (or securely positioned proximal to) leg 104 to arrest (or prevent) pivoting leg 104 about axis A2 in direction D3.

In some embodiments, any one of apertures 120 (see FIGS. 1 and 2) on each of lower portions 102*a*, 104*a*, and 106*a* of legs 102, 104 and 106 may allow lower portions 102*a*, 104*a*, and 106*a* of legs 102, 104 and 106 to be telescoped in by push button mechanism 122. Mechanism 122 may selectively engage any one of apertures 120 on each of lower portions 102*a*, 104*a*, and 106*a* of legs 102, 104 and 106 respectively. Telescoping in of first leg 102, second leg 104, and third leg 106 and moving handle 108 in direction D5 (in FIG. 5) may reduce the length of chair 100. In the collapsed position, chair 100 may have an overall length L1 that may be less than or equal to a predetermined longest allowable exterior dimension of a carry-on airline luggage piece (e.g., 19.5 inches), so that the user may stow chair 100 in the collapsed configuration in an overhead compartment of a commercial airliner.

Now referring to FIGS. 6-12, joint 110 may enable the transition of handle 108 from the extended configuration to the collapsed configuration (and vice versa), and locking mechanism 124 (see FIG. 2) of joint 110 may selectively secure handle 108 in the extended configuration (see FIG. 1 and solid lines in FIG. 5) and the collapsed configurations (see FIG. 13 and dash double dot lines in FIG. 5).

Figure 6:
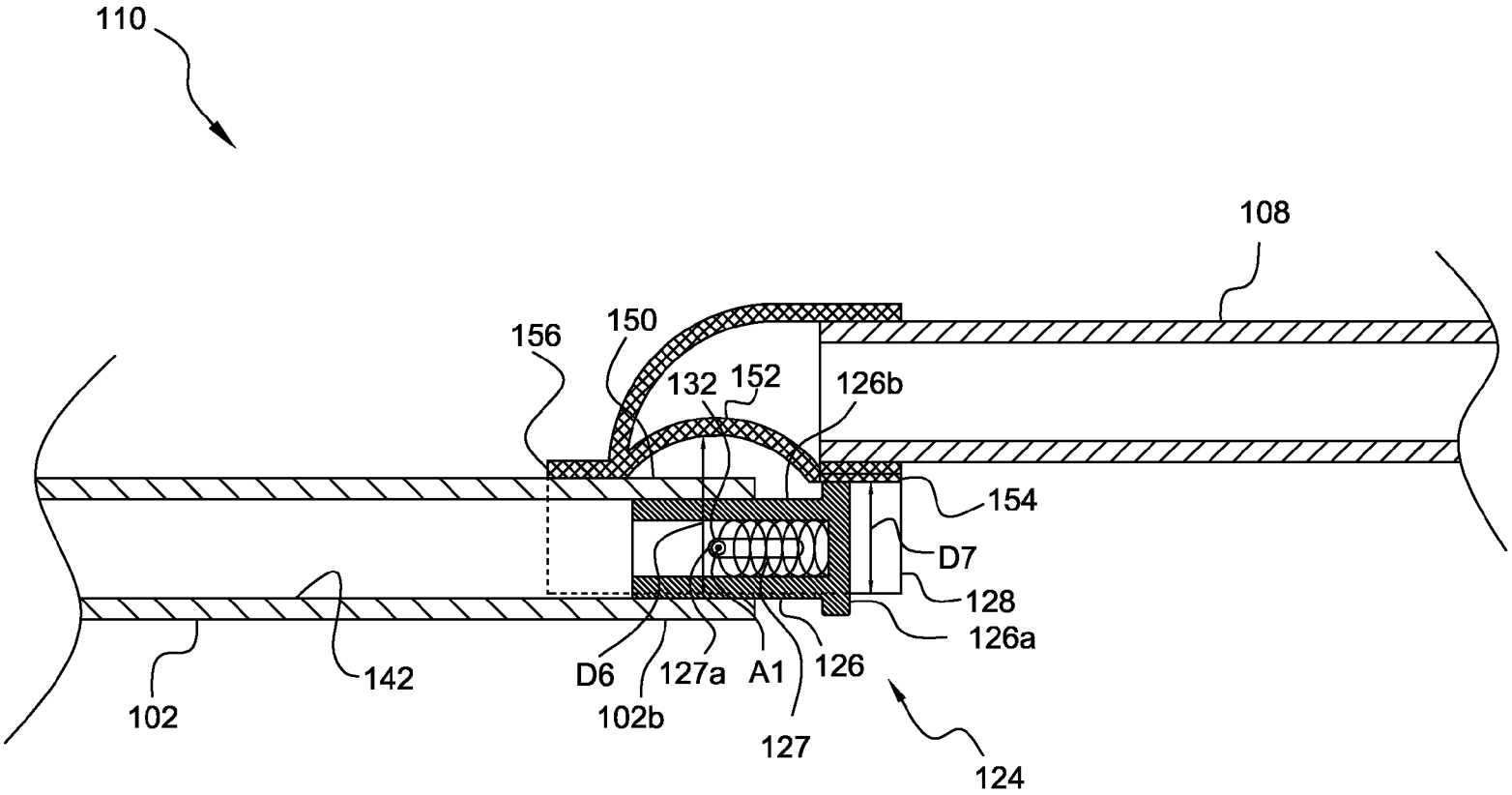
FIG. 6 is a semi-schematic cross-sectional view of the joint of FIG. 1 showing a lock plug in an OUT position to extend into and frictionally engage a first end portion of a trough to secure the handle in the extended configuration.

FIG. 6 is a cross-sectional view taken in a plane parallel to the view of FIG. 5 showing joint 110, a portion of handle 108, and a portion of leg 102, with handle 108 in the extended configuration (see handle 108 drawn in solid lines in FIG. 5 for the extended configuration of handle 108).

Figure 7:
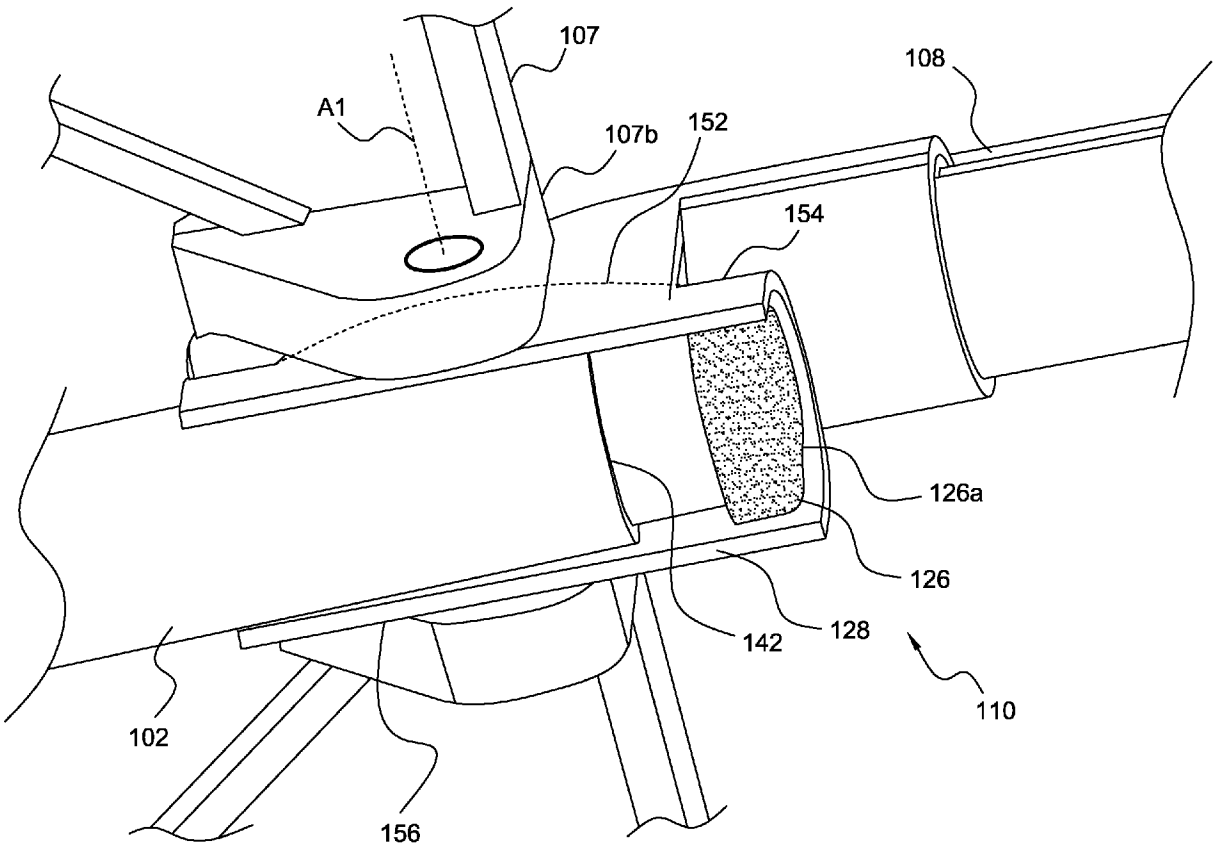
FIG. 7 is a bottom perspective view of the joint with the handle secured in the extended configuration and the seat in the collapsed configuration.

FIG. 7 is a perspective view from a bottom angle of a portion of the chair of FIG. 5 showing a bottom portion of seat 107 in the collapsed configuration, and handle 108 and joint 110 in similar positions as shown in FIG. 6.

Turning back to FIG. 6, trough 128 may be configured to wrap around a first side 150 of first leg 102 when handle 108 is in the extended configuration.

As shown in FIGS. 6 and 7, trough 128 may include a central portion 152 disposed between a first end portion 154 and a second end portion 156. Central portion 152 of trough 128 may have a greater depth than first and second end portions 154 and 156 of trough 128 in a direction perpendicular to handle pivot axis A1 (and an elongate direction of handle 108), as can be seen best in FIG. 6 in which a depth of central portion 152 is indicated at D6, and a depth of first and second end portions 154 and 156 is indicated at D7.

As shown in FIGS. 6 and 7, central portion 152 may include a dome-shaped structure to provide the greater depth. In other embodiments, central portion 152 of trough 128 may include any other suitable shaped structure or recess to provide the greater depth.

Lock plug 126 of joint 110 may be operable between an IN state (or IN position) and the OUT state (or OUT position). In FIGS. 6 and 7, lock plug 126 is shown in the OUT state. As shown, the OUT state may correspond to distal end 126*a* of lock plug 126 positioned proximal first end portion 154 of trough 128 when handle 108 is in the extended configuration such that lock plug 126 may extend into and frictionally engage first end portion 154 of trough 128 to prevent handle 108 from moving to the collapsed configuration. For example, lock plug 126 may contact (or press against) first end portion 154 of trough 128 when lock plug 126 is in the OUT position, and thereby may block the movement of handle 108 about axis A1 from the extended configuration to the collapsed configuration.

As shown in FIG. 6, in the OUT position of plug 126, pin 132 may be positioned proximal (or may contact) first end 127*a* of slot 127, and spring 130 may extend (and be retained) between pin 132 and distal end (or cap) portion 126*a* of plug 126. Spring 130 may bias plug 126 to the OUT position by pressing against pin 132, and pin 132 may retain a proximal (or rear) portion of plug 126 in bore 142. Spring 130 may extend in the recess of lock plug 126. Lock plug 126 enclosing spring 130 may be disposed in bore 142.

Figure 8:
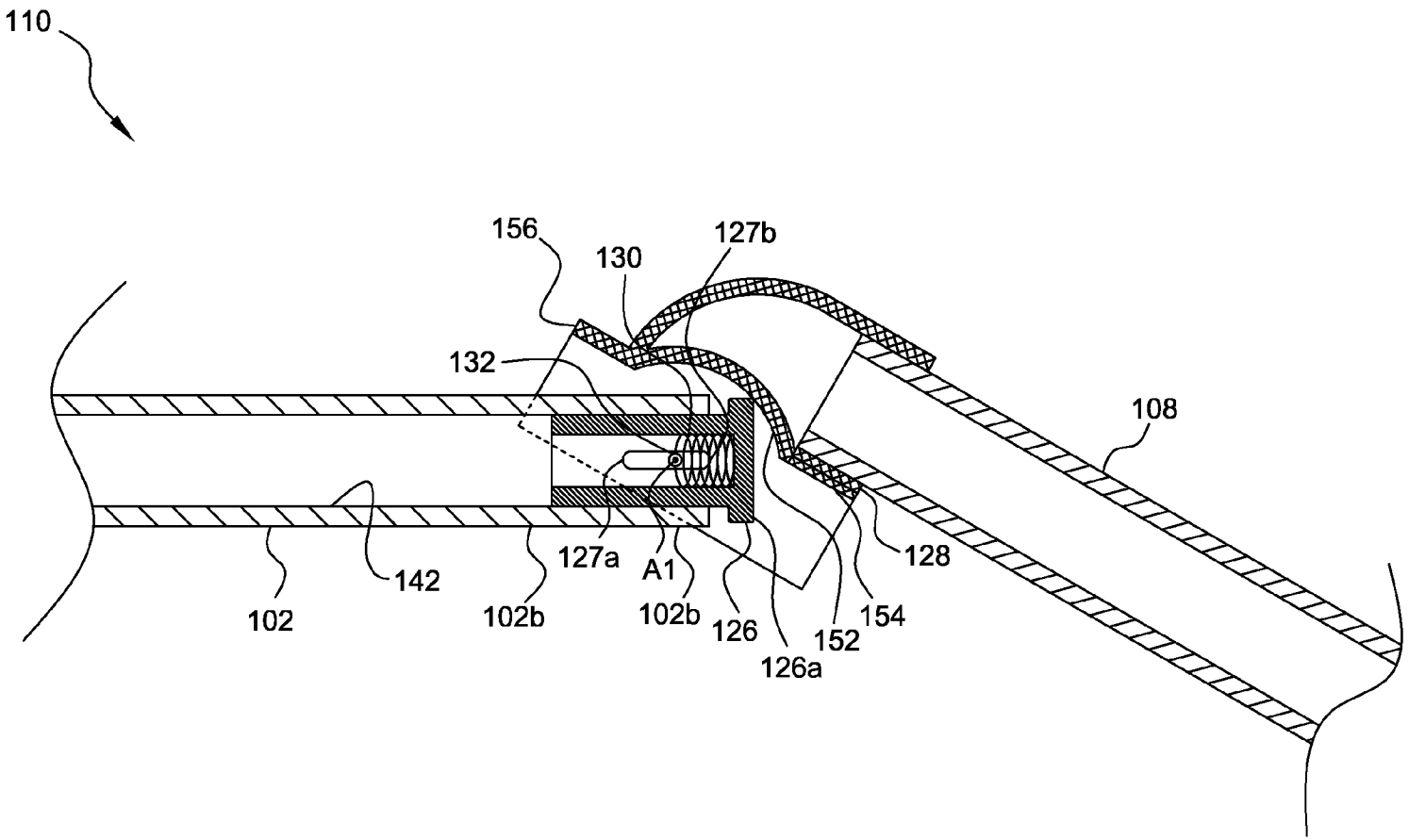
FIG. 8 is a semi-schematic cross-sectional view of the joint showing the lock plugdepressed to an IN position and the handle pivoted toward the first leg about a handle pivot axis.
Figure 9:
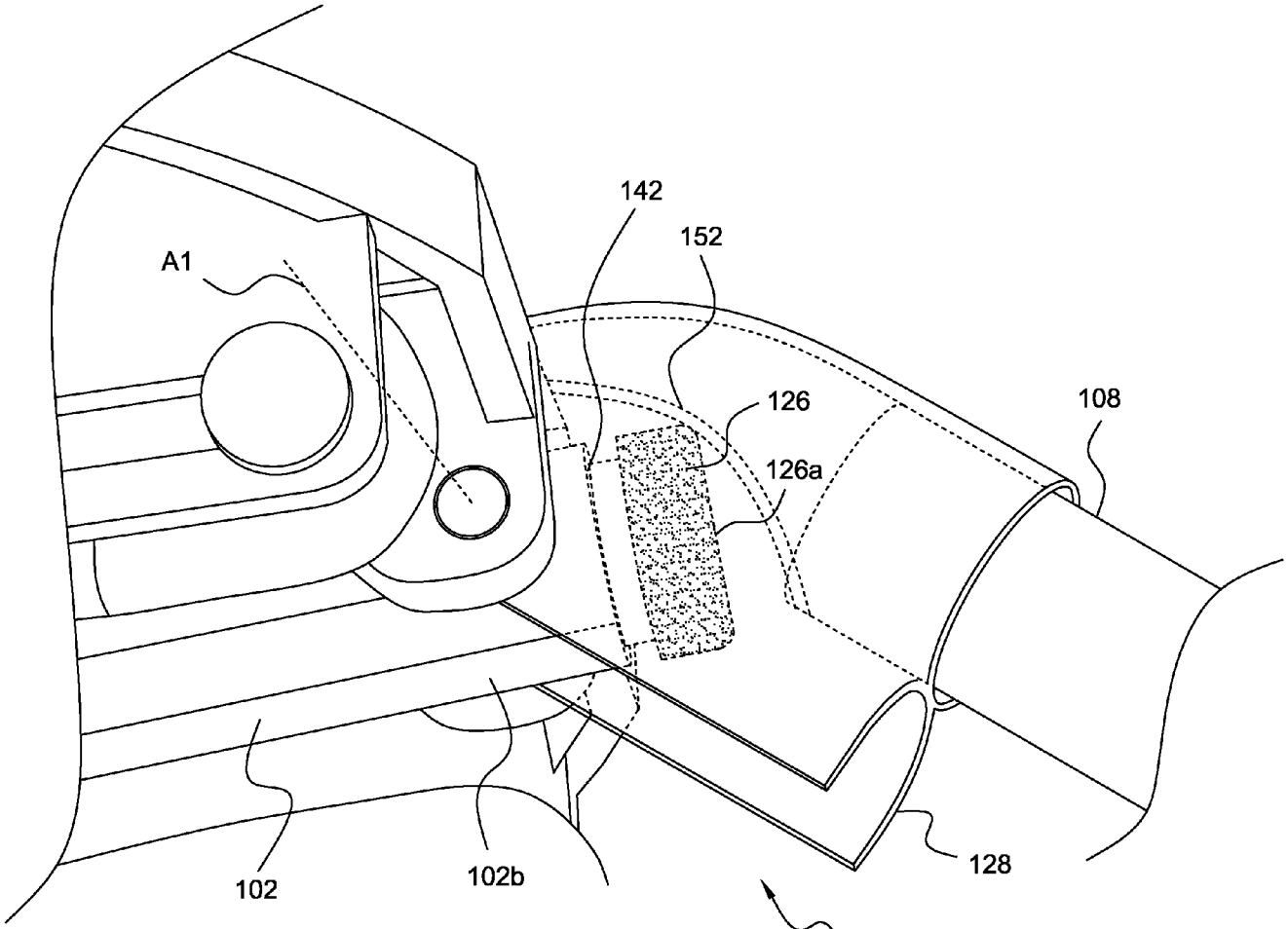
FIG. 9 is a perspective view of the joint in a position similar to that of FIG. 8.
Figure 10:
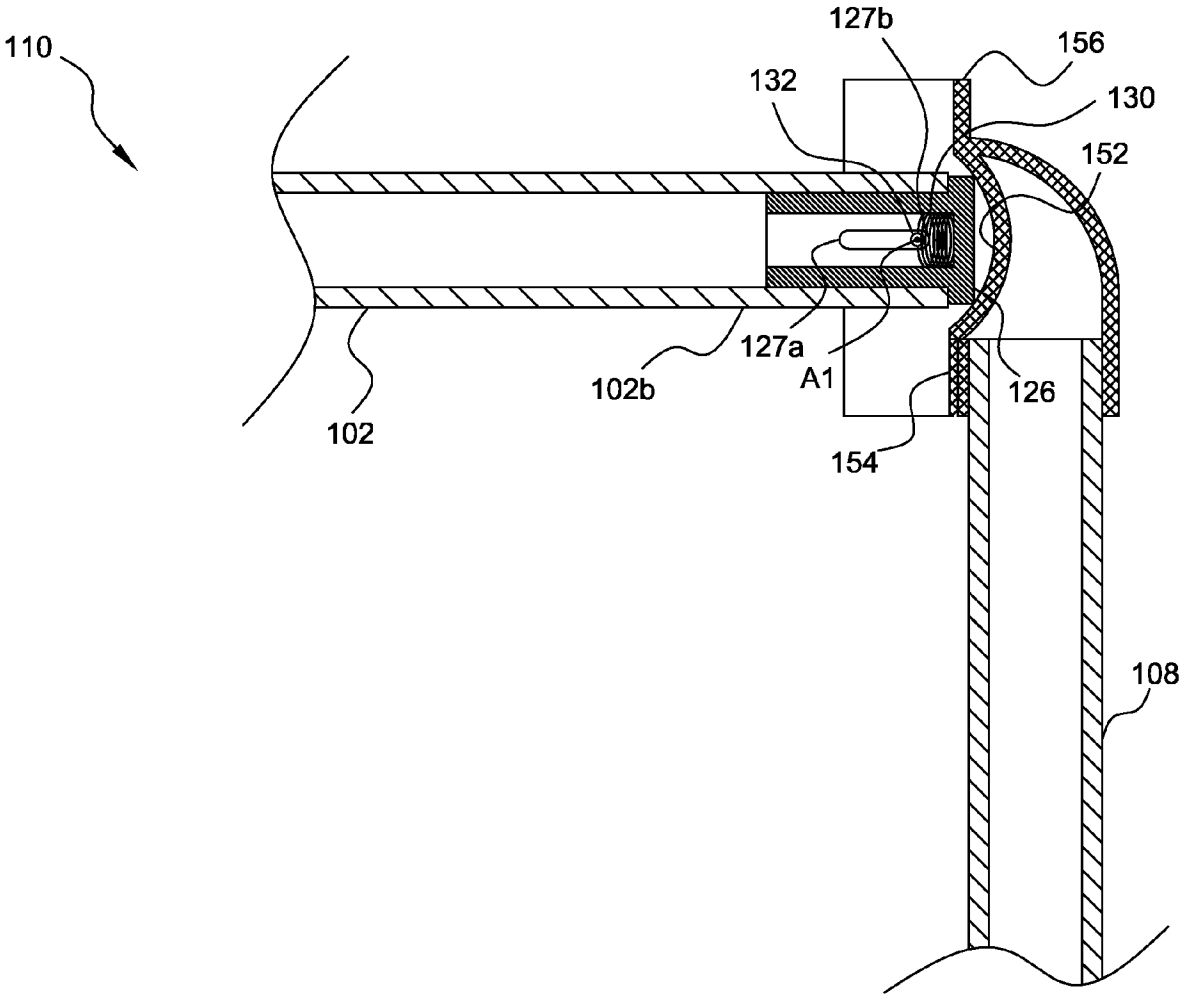
FIG. 10 is a semi-schematic cross-sectional view of the joint showing the handle further pivoted about the handle pivot axis, and the lock plug further depressed into a bore of the first leg.
Figure 11:
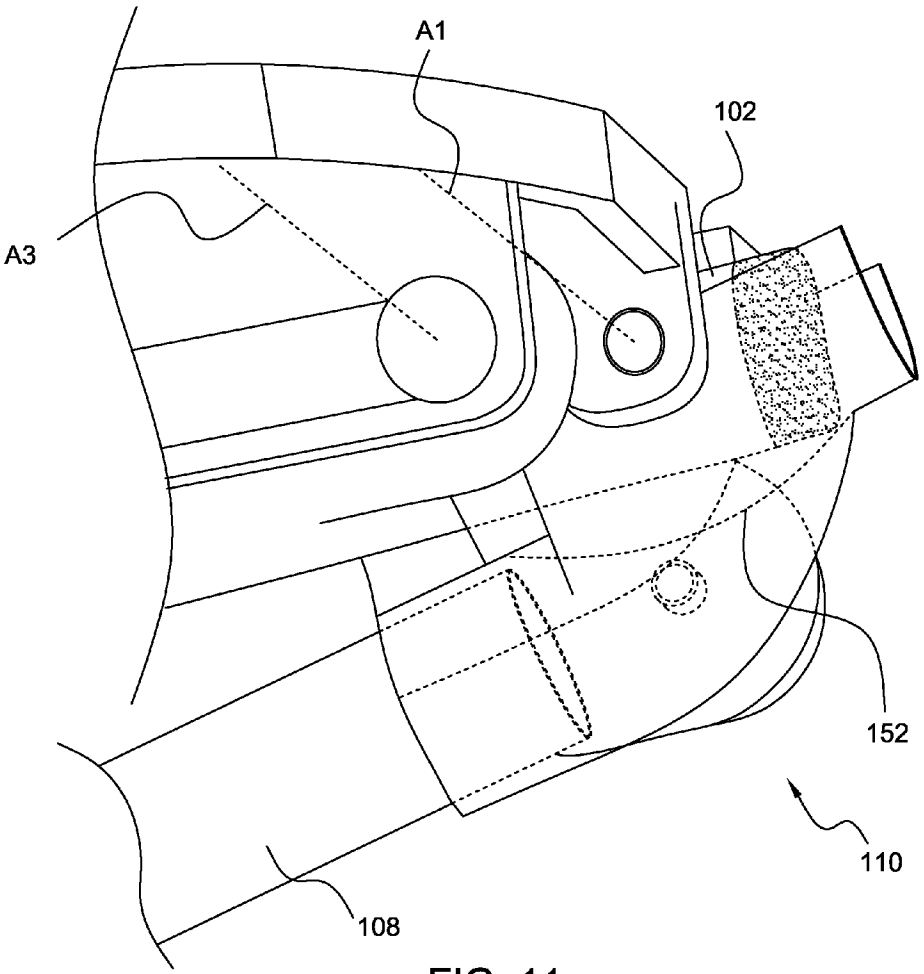
FIG. 11 is a perspective view of the joint showing the handle near the collapsed configuration and the lock plug near a second end portion of the trough.
Figure 12:
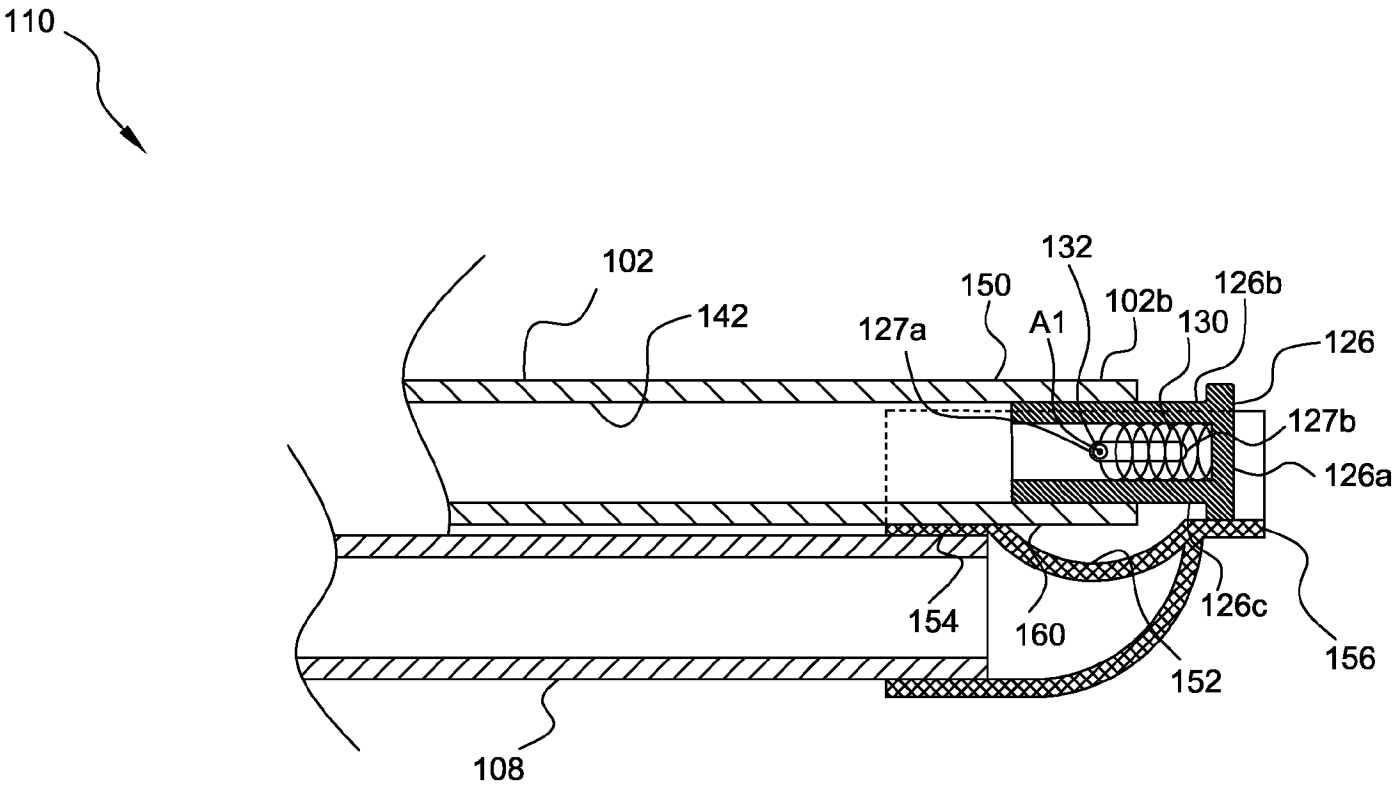
FIG. 12 is a semi-schematic cross-sectional view of the joint showing the lock plug in the OUT position to extend into and frictionally engage the second end portion of the trough to secure the handle in the collapsed configuration.

Handle 108 may be moved between the extended configuration (see FIG. 1 and FIG. 6) and the collapsed configuration (see FIG. 13 and the dash double dot lines of handle 108 in FIG. 5) by depressing lock plug 126 and flipping trough 128 to an opposite side of lock plug 126. For example, FIG. 6 shows trough 128 disposed around a first side 126*b* of lock plug 126, FIGS. 8-10 show lock plug 126 depressed to the IN state and trough 128 pivoting about axis A1, and FIG. 12 shows trough 128 completely flipped to a second side 126*c* of lock plug 126 that is opposite first side 126*b*.

The IN position of lock plug 126 may correspond to distal end 126*a* of lock plug 126 depressed to central portion 152 of trough 128 to allow handle 108 to pivot about handle pivot axis A1 between the extended and collapsed configurations. In this IN position (see FIGS. 8-11), lock plug 126 may extend further into bore 142 of leg 102 than when lock plug 126 is in the OUT position (see FIGS. 6 and 7).

In some embodiments, central portion 152 may frictionally engage depressed lock plug 126 and may apply appropriate pressure against a biasing force provided by spring 130 so that lock plug 126 may remain in the depressed position (i.e., the IN position) when handle 108 is moved between the extended configuration and the collapsed configuration (see FIGS. 8-11).

As previously described, lock plug 126 may be biased to the OUT state, for example, by spring 130. For example, spring 130 may apply a force on lock plug 126 in a direction from the IN state toward the OUT state. For example, as shown in FIGS. 8 and 10, the IN state of lock plug 126 may correspond a more compressed state of spring 130, and as shown in FIGS. 6 and 12, the OUT state of lock plug 126 may correspond to a less compressed state of spring 130.

In the IN position of lock plug 126 shown in FIGS. 8-11, handle 108 may pivot about handle pivot axis A1. As handle 108 pivots about handle pivot axis A1 to the collapsed configuration, as shown in FIG. 12, trough 128 may wrap around a second side 160 of first leg 102 opposite first side 150. As shown in FIGS. 8 and 10, the IN position may correspond to pin 132 being disposed (or positioned) proximal second end 127*b* and distal first end 127*a* of slot 127. In some embodiments, the IN position of plug 126 may correspond to pin 132 contacting second end 127*b* of slot 127.

FIG. 12 shows joint 110 when handle 108 is in the collapsed configuration. As shown, trough 128 may wrap around second side 160 of first leg 102 in the collapsed configuration of handle 108. As shown, the collapsed configuration of handle 108 may correspond to lock plug 126 pushed out to the OUT position by spring 130. When handle 108 is in the collapsed configuration, the OUT position of plug 126 may correspond to pin 132 disposed proximal (or pressing against) first end 127*a* of slot 127. In the OUT position, lock plug 126 may extend into and frictionally engage second end portion 156 to prevent handle 108 from pivoting about axis A1 from the collapsed configuration (shown in FIG. 12) toward the extended configuration (shown in FIG. 6).

FIG. 13 shows chair 100 with first leg 102, second leg 104, third leg 106, seat 107, and handle 108 all in their respective collapsed configurations. In FIG. 13, lower portions 102*a*, 104*a*, and 106*a* of legs 102, 104, and 106 have been telescoped in toward trough 128.

FIGS. 3-13 show chair 100 transitioning from the extended configuration to the collapsed configuration. However, chair 100 may also be transitioned from the collapsed configuration to the extended configuration by, for example, depressing lock plug 126 to the IN position, pivoting handle 108 in a direction opposite to direction D5 about axis A1 (see FIG. 5), telescoping out the lower portions of the legs in a direction opposite to D4 (see FIG. 5), pivoting seat 107 in a direction opposite to direction D3 (see FIG. 5), and pivoting legs 104 and 106 relative to leg 102 (see FIG. 4) about leg pivot axis A2 to slide axis A3 in the seat slots to a position near rear end portion 107*a* of seat 107 (see FIG. 2).

FIGS. 14-17 are cross-sectional views similar to FIGS. 6, 8, 10, and 12, but showing another embodiment of a lock plug, indicated at 226. In FIGS. 6, 8, 10, and 12, axis A1 may be defined by protrusions extending from opposite sides of leg 102 into respective apertures of trough 128, and as such may not interfere with movement of lock plug 126 and spring 130 in bore 142 of leg 102.

As shown, lock plug 226 includes a distal end 226*a* similar to distal end 126*a* of lock plug 126, a first side 226*b* similar to first side 126*b* of lock plug 126, and a second side 226*c* similar to second side 126*c* of lock plug 126. In the embodiment shown in FIGS. 6, 8, 10, and 12, a rear end of spring 130 may be substantially fixed (or secured) in bore 142, and a front end of spring 130 may press against lock plug 226 to bias lock plug 226 toward the OUT position (see FIGS. 14 and 17) and away from the IN position (see FIGS. 15 and 16).

The following paragraphs may provide further information regarding embodiments of the present disclosure.

A0. A chair operable between an extended configuration and a collapsed configuration, the chair comprising: one or more legs supporting a seat; a handle extending away from the seat opposite the one or more legs; and a locking mechanism including a lock plug disposed in an elongate trough, wherein moving the handle between the extended and collapsed configurations involves depressing the lock plug and flipping the trough to an opposite side of the lock plug.

A1. The chair of paragraph A0, wherein the one or more legs include a first leg, a second leg, and a third leg, the trough pivotally connecting the handle to the first leg about a handle pivot axis.

A2. The chair of paragraph A1, wherein the trough is configured to wrap around a first side of the first leg when the handle is in the extended configuration, and to wrap around a second side of the first leg opposite the first side when the handle is in the collapsed configuration.

A3. The chair of paragraph A1, wherein each of the legs includes a lower portion, an upper portion, and a central portion connecting the lower portion to the upper portion, the central portion of the first leg being pivotally connected to the central portions of the second and third legs, a front portion of the seat being pivotally connected to the upper portion of first leg about a seat pivot axis, the seat including a slot extending from a rear portion of the seat toward the front portion of the seat, at least one of the upper portions of the second and third legs including a pin slidingly engaged in the slot, and movement of the chair from the extended configuration toward the collapsed configuration involves the pin sliding in the slot toward the seat pivot axis as the lower portions of the second and third legs pivot toward the lower portion of the first leg.

A4. The chair of paragraph A3, wherein the trough pivotally connects the handle to the upper portion of the first leg about the handle pivot axis, and operating the chair from the extended configuration toward the collapsed configuration involves pivoting the handle about the handle pivot axis toward the leg pivot axis to position the upper portions of the first, second, and third legs between the seat and the handle.

A5. The chair of paragraph A4, wherein operating the chair from the extended configuration to the collapsed configuration involves telescoping in the lower portions of the first, second, and third legs toward the trough.

A6. The chair of paragraph A5, wherein the chair in the collapsed configuration has an overall length that is less than or equal to a predetermined longest allowable exterior dimension of a carry-on airline luggage piece.

B0. A chair operable between an extended configuration and a collapsed configuration, the chair comprising: one or more legs supporting a seat, and a handle extending away from the seat opposite the one or more legs, wherein the handle and the seat are pivotally connected to at least one of the legs about a combined pivot axis.

B1. The chair of paragraph B0, the one or more legs includes a first leg, a second leg, and a third leg, each of the legs including a central portion connecting a lower portion to an upper portion, the central portion of the first leg being pivotally connected to the central portions of the second and third legs about a leg pivot axis, the handle and the seat being pivotally connected to the upper portion of the first leg about the combined pivot axis.

B2. The chair of paragraph B1, wherein operating the chair from the extended configuration toward the collapsed configuration involves pivoting of the upper portions of the second and third legs toward the upper portion of the first leg about the leg pivot axis, pivoting of the seat about the combined pivot axis in a first direction, and pivoting of the handle about the combined pivot axis in a second direction opposite the first direction to position the first, second, and third legs between the seat and the handle.

B3. The chair of paragraph B9, wherein the handle includes a trough, the combined pivot axis passing through the trough, the chair including a lock plug operable between an OUT position and an IN position, the OUT position corresponding to the lock plug extending into and frictionally engaging a portion of the trough extending away from the upper portion of the first leg, the IN position corresponding to the lock plug depressed toward the central portion of first leg to allow the handle to pivot about the combined pivot axis.

B4. The chair of paragraph B3, wherein the first leg includes a bore extending from the upper portion of the first leg toward the central portion of the first leg, the lock plug extending further into the bore when the lock plug is in the IN position than when the lock plug is in the OUT position.

C0 A chair operable between an extended configuration and a collapsed configuration, the chair comprising: one or more legs supporting a seat; a handle extending away from the seat opposite the one or more legs; and a joint pivotally connecting the handle to at least one of the legs about a handle pivot axis, the joint including a locking mechanism for selectively securing the handle in the extended and collapsed configurations.

C1. The chair of claim C0, wherein the locking mechanism includes a lock plug and a trough, the lock plug having a distal end, the trough having a central portion disposed between first and second end portions, the lock plug being operable between an IN state and an OUT state, the OUT state corresponding to the distal end of the lock plug positioned proximal the first end portion of the trough when the handle is in the extended configuration such that the lock plug frictionally engages the first end portion of the trough to prevent the handle from moving to the collapsed configuration.

C2. The chair of claim C1, wherein the OUT state of the lock plug corresponds to the distal end of the lock plug positioned proximal the second end portion of the trough when the handle is in the collapsed configuration such that the lock plug frictionally engages the second end portion of the trough to prevent the handle from moving to the extended configuration.

C3. The chair of claim C2, wherein the central portion of the trough has a greater depth than the first and second end portions of the trough in a direction perpendicular to the handle pivot axis and an elongate direction of the trough, and the IN state of the lock plug corresponds to the distal end of the lock plug depressed to the central portion of the trough to allow the handle to pivot about the handle pivot axis between the extended and collapsed configurations.

C4. The chair of claim C3, wherein the lock plug is biased by a spring toward the OUT state.

C5. The chair of claim C0, wherein the one or more legs includes a first leg, a second leg, and a third leg, each of the legs including a central portion connecting a lower portion to an upper portion, the central portion of the first leg being pivotally connected to the central portions of the second and third legs about a leg pivot axis, the joint pivotally connecting the handle to the upper portion of the first leg about the handle pivot axis, and operating the chair from the extended configuration to the collapsed configuration involves pivoting the first leg relative to the second and third legs about the leg pivot axis, and pivoting the handle toward the leg pivot axis about the handle pivot axis to position the first leg, the second leg, the third leg, and the handle in a substantially flat configuration.

C6. The chair of claim C5, wherein the seat includes a front portion, a rear portion, and a pair of slots extending from the rear portion toward the front portion, the front portion of the seat being pivotally connected to the upper portion of the first leg about a seat pivot axis, the upper portions of the second and third legs including respective pins that are slidingly engaged in the slots, and operating the chair from extended configuration to the collapsed configuration involves the pins sliding toward the front portion of the seat, and the seat pivoting toward the leg pivot axis to position the upper portions of the first, second, and third legs between the seat and the handle.

C7. The chair of claim C6, wherein the pins define a sliding axis that is offset from the seat pivot axis in the collapsed configuration, and the handle secured in the collapsed configuration prevents pivoting of the upper portions of the second and third legs relative to the upper portion of the first leg and thereby prevents the seat from moving to the extended configuration.

It is believed that the disclosure set forth herein encompasses multiple distinct disclosures with independent utility. While each of these disclosures has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A chair operable between an extended configuration and a collapsed configuration, the chair comprising:

one or more legs supporting a seat;

a handle extending away from the seat opposite the one or more legs;

a locking mechanism including a lock plug disposed in an elongate trough, wherein moving the handle between the extended and collapsed configurations involves depressing the lock plug and flipping the trough to an opposite side of the lock plug; and wherein the one or more legs include a first leg, a second leg, and a third leg, the trough pivotally connecting the handle to the first leg about a handle pivot axis.

2. The chair of claim 1, wherein the trough is configured to wrap around a first side of the first leg when the handle is in the extended configuration, and to wrap around a second side of the first leg opposite the first side when the handle is in the collapsed configuration.

3. The chair of claim 1, wherein each of the legs includes a lower portion, an upper portion, and a central portion connecting the lower portion to the upper portion, the central portion of the first leg being pivotally connected to the central portions of the second and third legs, a front portion of the seat being pivotally connected to the upper portion of first leg about a seat pivot axis, the seat including a slot extending from a rear portion of the seat toward the front portion of the seat, at least one of the upper portions of the second and third legs including a pin slidingly engaged in the slot, and movement of the chair from the extended configuration toward the collapsed configuration involves the pin sliding in the slot toward the seat pivot axis as the lower portions of the second and third legs pivot toward the lower portion of the first leg.

4. The chair of claim 3, wherein the trough pivotally connects the handle to the upper portion of the first leg about the handle pivot axis, and operating the chair from the extended configuration toward the collapsed configuration involves pivoting the handle about the handle pivot axis toward the leg pivot axis to position the upper portions of the first, second, and third legs between the seat and the handle.

5. The chair of claim 4, wherein operating the chair from the extended configuration to the collapsed configuration involves telescoping in the lower portions of the first, second, and third legs toward the trough.

6. The chair of claim 5, wherein the chair in the collapsed configuration has an overall length that is less than or equal to a predetermined longest allowable exterior dimension of a carry-on airline luggage piece.

7. A chair operable between an extended configuration and a collapsed configuration, the chair comprising:

one or more legs supporting a seat, a handle extending away from the seat opposite the one or more legs, wherein the handle and the seat are pivotally connected to at least one of the legs about a combined pivot axis; and wherein the one or more legs includes a first leg, a second leg, and a third leg, each of the legs including a central portion connecting a lower portion to an upper portion, the central portion of the first leg being pivotally connected to the central portions of the second and third legs about a leg pivot axis, the handle and the seat being pivotally connected to the upper portion of the first leg about the combined pivot axis.

8. The chair of claim 7, wherein operating the chair from the extended configuration toward the collapsed configuration involves pivoting of the upper portions of the second and third legs toward the upper portion of the first leg about the leg pivot axis, pivoting of the seat about the combined pivot axis in a first direction, and pivoting of the handle about the combined pivot axis in a second direction opposite the first direction to position the first, second, and third legs between the seat and the handle.

9. The chair of claim 8, wherein the handle includes a trough, the combined pivot axis passing through the trough, the chair including a lock plug operable between an OUT position and an IN position, the OUT position corresponding to the lock plug extending into and frictionally engaging a portion of the trough extending away from the upper portion of the first leg, the IN position corresponding to the lock plug depressed toward the central portion of first leg to allow the handle to pivot about the combined pivot axis.

10. The chair of claim 9, wherein the first leg includes a bore extending from the upper portion of the first leg toward the central portion of the first leg, the lock plug extending further into the bore when the lock plug is in the IN position than when the lock plug is in the OUT position.

11. A chair operable between an extended configuration and a collapsed configuration, the chair comprising:

one or more legs supporting a seat;

a handle extending away from the seat opposite the one or more legs;

a joint pivotally connecting the handle to at least one of the legs about a handle pivot axis, the joint including a locking mechanism for selectively securing the handle in the extended and collapsed configurations; and wherein the locking mechanism includes a lock plug and a trough, the lock plug having a distal end, the trough having a central portion disposed between first and second end portions, the lock plug being operable between an IN state and an OUT state, the OUT state corresponding to the distal end of the lock plug positioned proximal the first end portion of the trough when the handle is in the extended configuration such that the lock plug frictionally engages the first end portion of the trough to prevent the handle from moving to the collapsed configuration.

12. The chair of claim 11, wherein the OUT state of the lock plug corresponds to the distal end of the lock plug positioned proximal the second end portion of the trough when the handle is in the collapsed configuration such that the lock plug frictionally engages the second end portion of the trough to prevent the handle from moving to the extended configuration.

13. The chair of claim 12, wherein the central portion of the trough has a greater depth than the first and second end portions of the trough in a direction perpendicular to the handle pivot axis and an elongate direction of the trough, and the IN state of the lock plug corresponds to the distal end of the lock plug depressed to the central portion of the trough to allow the handle to pivot about the handle pivot axis between the extended and collapsed configurations.

14. The chair of claim 13, wherein the lock plug is biased by a spring toward the OUT state.

15. The chair of claim 11, wherein the one or more legs includes a first leg, a second leg, and a third leg, each of the legs including a central portion connecting a lower portion to an upper portion, the central portion of the first leg being pivotally connected to the central portions of the second and third legs about a leg pivot axis, the joint pivotally connecting the handle to the upper portion of the first leg about the handle pivot axis, and operating the chair from the extended configuration to the collapsed configuration involves pivoting the first leg relative to the second and third legs about the leg pivot axis, and pivoting the handle toward the leg pivot axis about the handle pivot axis to position the first leg, the second leg, the third leg, and the handle in a substantially flat configuration.

16. The chair of claim 15, wherein the seat includes a front portion, a rear portion, and a pair of slots extending from the rear portion toward the front portion, the front portion of the seat being pivotally connected to the upper portion of the first leg about a seat pivot axis, the upper portions of the second and third legs including respective pins that are slidingly engaged in the slots, and operating the chair from extended configuration to the collapsed configuration involves the pins sliding toward the front portion of the seat, and the seat pivoting toward the leg pivot axis to position the upper portions of the first, second, and third legs between the seat and the handle.

17. The chair of claim 16, wherein the pins define a sliding axis that is offset from the seat pivot axis in the collapsed configuration, and the handle secured in the collapsed configuration prevents pivoting the upper portions of the second and third legs relative to the upper portion of the first leg and thereby prevents the seat from moving to the extended configuration.

* * * * *